US005776664A

United States Patent [19]

Yamashita et al.

[11] Patent Number: 5,776,664

[45] Date of Patent: Jul. 7, 1998

[54] SILVER HALIDE PHOTOGRAPHIC MATERIAL

[75] Inventors: Seiji Yamashita; Koki Nakamura; Koichi Nakamura, all of Kanagawa, Japan

[73] Assignee: Fuji Photo Film Co., Ltd., Kanagawa, Japan

[21] Appl. No.: 664,586

[22] Filed: Jun. 17, 1996

[30] Foreign Application Priority Data

Jun. 15, 1995 [JP] Japan ..... 7-171602

[51] Int. Cl.[6] ..... G03C 1/295; G03C 1/42

[52] U.S. Cl. ..... 430/405; 430/139; 430/264; 430/380; 430/475; 430/587; 430/556; 430/566; 430/567; 430/963; 430/966

[58] Field of Search ..... 430/963, 567, 430/966, 556, 487, 264, 475, 380, 566, 405, 139

[56] References Cited

U.S. PATENT DOCUMENTS

| | | | |
|---|---|---|---|
| 2,685,516 | 8/1954 | Wilson | 430/587 |
| 4,409,324 | 10/1983 | Ishikawa et al. | 430/587 |
| 5,284,739 | 2/1994 | Clarke et al. | 430/504 |
| 5,601,969 | 2/1997 | Verbeek | 430/569 |

*Primary Examiner*—Thorl Chea

*Attorney, Agent, or Firm*—Sughrue, Mion, Zinn, Macpeak & Seas, PLLC

[57] ABSTRACT

A silver halide photographic material comprising: (a) a silver chloride-containing emulsion comprising a dispersion medium and a silver halide grain, wherein the silver halide grain contains a tabular grain having an average aspect ratio of not less than 2 accounting for at least 50% of the entire projected area thereof and has a silver chloride content of not less than 20 mol %; (b) a developing agent; and (c) a compound capable of forming a dye image upon development.

14 Claims, No Drawings

SILVER HALIDE PHOTOGRAPHIC MATERIAL

FIELD OF THE INVENTION

The present invention relates to a silver halide photographic material capable of rapid processing in spite of an extremely small amount of replenisher or waste of the developer or the fixing solution. Also, the present invention relates to an X-ray photographic material for medical use capable of providing an X-ray photographic image having an excellent quality even when the processing is performed rapidly and at a low replenishing rate.

BACKGROUND OF THE INVENTION

A large number of prior techniques are present with respect to the tabular grain having a high silver chloride content. Examples of the tabular grain having main planes of (111) face include those described in JP-B-64-8326 (the term "JP-B" as used herein means an "examined Japanese patent publication"), JP-B-64-8325, JP-B-64-8324, JP-A-1-250943 (the term "JP-A" as used herein means an "unexamined published Japanese patent Application"), JP-B-3-14328, JP-B-4-81782, JP-B-5-40298, JP-B-5-39459, JP-B-5-12696, JP-A-63-213836, JP-A-63-218938, JP-A-63-281149 and JP-A-62-218959.

Examples of the tabular grain having main planes of (100) face include those described in JP-A-5-204073, JP-A-51-88017 and JP-A-63-24238. JP-A-6-059360 describes a silver chloride-containing {100} tabular grain.

Further, a large number of prior techniques are present with respect to a silver halide light-sensitive material having incorporated thereinto a developing agent. For example, a technique of incorporating a developing agent into a photographic light-sensitive material and developing the material with an alkaline solution containing substantially no developing agent is disclosed in *Research Disclosure*, No. 173, KAN 17364 (1978), JP-A-50-39928, JP-A-57-84448 and JP-A-63-228148. According to the technique disclosed in these references, the development must be performed with an alkaline solution having a high pH (pH of from 12 to 14) in order to obtain sufficiently high density, and this method is not preferred in view of environmental issue.

Furthermore, these conventional techniques are defective in that for obtaining a sufficiently high density, the coated silver amount in the photographic light-sensitive material is large, which gives rise to the increase in the fixing load and the failure in reducing the replenishing amount.

Recently, in the art, reduction in the environmental load or the waste amount and recycling are demanded and to cope with the trend, reduction in the processing chemicals for use in the developer and tremendous reduction in the replenishing amount are being driven aggressively.

However, in order to maintain the photographic property in a continuous processing or a leisured processing, the replenishing amount may be reduced but in turn, the concentration of processing chemicals in the replenisher further increases, thus, in the status quo, reduction in the processing chemicals has not yet been achieved. Also, along the replenishing amount becomes smaller, there arise problems such that stains or fluctuations in the photographic performances increase due to the accumulated components.

As an effective means to overcome the problems accompanying the reduction of processing chemicals or reduction in the replenishing amount, it has been proposed to incorporate a developing agent or a precursor thereof into the light-sensitive material as described, for example, in U.S. Pat. Nos. 2,507,141, 3,764,328 and 4,060,418, JP-A-56-6235 and JP-A-58-192031. However, the aromatic primary amine and a precursor thereof are unstable and they are defective in that stains are generated during a long-term storage of an unprocessed light-sensitive material or at the time of color development.

Other than the color developing method, for example, European Patents 0545491A1 and 0565165A1 disclose a method of incorporating a sulfonhydrazide-type compound into a light-sensitive layer. However, even in this method, a hydrophilic and highly reducing pyrazolidone such as 1-phenyl-4-methyl-4-hydroxymethyl-3-pyrazolidone is used in the developer, for example, as an auxiliary developing agent. As a result, the developer deteriorates in a continuous processing or a leisured processing and therefore, a large amount of replenisher is required to maintain the photographic performances. It is also found that although silver development proceeds rapidly, the color density is low and the color mixing is intense.

SUMMARY OF THE INVENTION

A first object of the present invention is to provide a silver halide photographic material which is highly sensitive but can be developed in a processing system of extremely reduced replenishing amount and small waste amount.

A second object of the present invention is to provide a silver halide photographic material imparted with the aging stability which has been conventionally a matter of problem in a highly sensitive light-sensitive material having incorporated thereinto a developing agent.

A third object of the present invention is to provide a silver halide photographic material capable of processing within a total processing time of 90 seconds or less which has been unable to achieve in an image formation system using a dye image and a silver image in combination.

A fourth object of the present invention is to provide a silver halide photographic material for use in the formation of a high-quality, medical X-ray image, which is highly sensitive and in spite of capability of rapid and low replenishment processing, excellent in the sharpness.

The above-described objects of the present invention can be attained by:

1) A silver halide photographic material comprising:
   (a) a silver chloride-containing emulsion comprising a dispersion medium and a silver halide grain, wherein the silver halide grain contains a tabular grain having an average aspect ratio of not less than 2 accounting for at least 50% of the entire projected area thereof and has a silver chloride content of not less than 20 mol %;
   (b) a developing agent; and
   (c) a compound capable of forming a dye image upon development;
2) a silver halide photographic material as described in the above 1), wherein the material forms an image comprising a developed silver image and a dye image;
3) a silver halide photographic material as described in the above 1) or 2), wherein the material can be processed by an automatic developing machine within the total processing time of not more than 90 seconds; and
4) a silver halide photographic material as described in any of the above 1) to 3), wherein the material comprises a support having emulsion layers on both sides of the support and is set to have a crossover light of less than 20% in an X-ray image formation system of forming an image in combination with a phosphor screen.

DETAILED DESCRIPTION OF THE INVENTION

The present invention is described in detail below.

The silver chloride tabular emulsion of the present invention is a silver halide emulsion containing at least a dispersion medium and a silver halide grain. In the silver halide grains, 50% or more, preferably from 60 to 100%, more preferably from 70 to 100% of the entire projected area are occupied by tabular grains having an aspect ratio of not less than 2 and generally having main plains of (100) or (111) face. The silver halide grains have a $Cl^-$content of 20 mol % or more, preferably from 30 to 100 mol %, more preferably from 40 to 100 mol %, still more preferably from 50 to 100 mol %. The term "tabular grain" as used herein means a grain having an aspect ratio (diameter/thickness) of 1 or more. The main plain indicates the largest outer surface of a tabular grain. The thickness of the tabular grain is generally 0.35 μm or less, more preferably from 0.05 to 0.3 μm, still more preferably from 0.05 to 0.25 μm. The average aspect ratio of the tabular grains is 2 or more, preferably from 2 to 25, more preferably from 5 to 20. The term "diameter" as used herein means a diameter of a circle having an area equal to the projected area of the tabular grain and the term "thickness" as used herein means a distance between two main planes. The average aspect ratio is an average of aspect ratios of all tabular grains.

Of the emulsions of the present invention, with respect to the emulsion having main planes of (111) face, the nucleation thereof is described in detail in JP-B-64-8326, JP-B-64-8325, JP-B-64-8324, JP-A-1-250943, JP-B-3-14328, JP-B-4-81782, JP-B-5-40298, JP-B-5-39459, JP-B-5-12696, JP-A-63-213836, JP-A-63-218938, JP-A-63-281149 and JP-A-62-218959. The tabular grain having main planes of (100) face is described in JP-A-5-204073, JP-A-51-88017, JP-A-63-24238 and JP-A-7-146522.

In the present invention, the nucleation methods described in these publications may be freely selected and used.

The crystal growing method by the physical ripening (fine grains dissolve and substrate grains grow) effected in the presence of silver halide fine grains of the present invention is described below.

According to the fine grain emulsion addition method, an AgX (wherein X represents a halogen atom) fine grain emulsion having a grain size of 0.15 μm or less, preferably 0.1 μm or less, more preferably from 0.06 to 0.006 μm is added to an reaction vessel and the tabular grains are grown by Ostwald ripening. The fine grain emulsion may be added either continuously or continually. The fine grain emulsion may be continuously prepared in a mixer provided in the vicinity of a reaction vessel by supplying an $AgNO_3$ solution and an $X^-$salt solution and immediately and continuously added to the reaction vessel, or may be batchwise prepared in advance in a separate vessel and continuously or continually added to the reaction vessel. The fine grain emulsion may be added either as a solution or as dry powder. The dry powder may be mixed with water immediately before the addition and added as a solution. The fine grains are preferably added such that they disappear within 20 minutes, preferably from 10 seconds to 10 minutes. If the time until disappearance is prolonged, ripening starts among grains and the grain size is disadvantageously increased. Accordingly, it is preferred not to add the entire of fine grain emulsion at once. The fine grain preferably contains substantially no multiple twin grain. The term "multiple twin grain" as used herein means a grain having two or more twin planes per one grain. The term "contains substantially no" as used herein means that the ratio by number of multiple twin grains is 5% or less, preferably 1% or less, more preferably 0.1% or less. Further, the fine grain preferably contains substantially no single twin grain. Furthermore, the fine grain preferably contains substantially no screw dislocation. The term "contains substantially no" as used herein has the same meaning as defined above.

The fine grain has a halogen composition of AgCl, AgBr, AgBrI (wherein $I^-$ content is preferably 10 mol % or less, more preferably 5 mol % or less), or a mixed crystal comprising a combination of two or more thereof. The halogen composition of the fine grain is described in detail in JP-A-6-59360.

The total addition amount of fine grains is generally required to be 20% or more of the entire silver halide amount but it is preferably 40% or more, more preferably from 50 to 98%, of the entire silver halide amount.

The Cl content of the fine grain is preferably 10% or more, more preferably from 50 to 100%.

The dispersion medium for use in the nucleation, the ripening and the growth may be a conventionally known dispersion medium for AgX emulsion, however, gelatin having a methionine content of preferably from 0 to 50 μmol/g, more preferably from 0 to 30 μmol/g is particularly preferably used. When the gelatin is used in the ripening and the growth, tabular grains uniform in the diameter grain size and further reduced in the thickness are advantageously formed. Also, synthetic polymers described in JP-B-52-16365, *Nippon Shashin Gakkai Shi*, Vol. 29 (1), 17, 22 (1966), ibid., Vol. 30 (1), 10, 19 (1967), ibid., Vol. 30 (2), 17 (1967), and ibid., Vol. 33 (3), 24 (1967) may be preferably used as the dispersion medium. At the growth time after addition of fine grains, the pH is required to be 2.0 or more but it is preferably from 6 to 10, more preferably from 6 to 9.

The pCl needs be 1.0 or more but it is preferably 1.6 or more, more preferably from 2.0 to 3.0.

The above-described growth conditions are particularly preferred in case of a tabular grain having main planes of (100) face.

The pCl as used herein is defined by the formula:

$$pCl=-\log [Cl^-]$$

wherein $[Cl^-]$ is an activity of Cl ions in the solution. This is described in detail in T. H. James, *The Theory of the Photographic Process,* 4th ed., Chapter 1.

If the pH is less than 2.0, for example, in the case of a tabular grain having main planes of (100) face, the growth in the transverse direction is suppressed to reduce the aspect ratio and as a result, the covering power of the emulsion is liable to diminish and at the same time, the sensitivity is lowered. If the pH exceeds 2.0, the growth rate in the transverse direction is increased and the emulsion can have a high aspect ratio and an intense covering power, however, the fog is high and the sensitivity is readily lowered.

If the pCl is less than 1.0, the growth in the vertical direction is accelerated to lower the aspect ratio and as a result, the covering power of the emulsion diminishes and the sensitivity is lowered. If the pCl exceeds 1.6, the aspect ratio becomes high and the covering power is intensified, however, the fog is high and the sensitivity is readily lowered. In this case, when substrate grains are grown by the silver halide fine grains, the emulsion achieves low fogging, high sensitivity and high covering power with a higher aspect ratio even at a pH of 6 or more and/or a pCl of 1.6 or more.

The monodispersibility of the emulsion of the present invention is, in terms of the coefficient of variation defined for the monodispersibility by the method described in JP-A-59-745481, preferably 30% or less, more preferably from 5 to 25%. In the case of using a high contrast light-sensitive material, it is preferably from 5 to 15%.

The selenium sensitization and the tellurium sensitization which are preferred in the present invention are described below. These sensitization methods may be used either individually or in combination. Preferable use examples of these methods and preferred examples of the compound for use in these methods are described in detail, for example, in JP-A-3-116132, JP-A-5-113635, JP-A-5-165136, JP-A-5-165137 and JP-A-5-134345.

Particularly preferred examples of the selenium sensitizer include compounds represented by formulae (I) and (II) of JP-A-5-165137 and Compounds I-1 to I-20 and Compounds II-1 to II-19 described in this patent publication. Examples of the tellurium sensitizer include compounds represented by formulae (IV) and (V) of JP-A-5-134345 and Compounds IV-1 to IV-22 and Compound V-1 to V-16 described in this publication.

The formation of silver chloride-containing tabular grain of the present invention is performed using a multiple coaxial nozzle described in JP-A-4-139439, JP-A-4-139440, JP-A-4-139441 and U.S. Pat. No. 5,104,786, by adding an aqueous halogen solution and an aqueous silver nitrate solution mixed immediately before addition to the reaction vessel, so that the nucleation and the growth can be advantageously performed.

The compound which reacts with a developing agent or an oxidation product of the developing agent to form a dye image, of the present invention is described in detail below.

In the present invention, an image is formed by the development based on the density of developed silver and the dye image formed in correspondence thereto, and the dye image formation method of the present invention may suffice if an image can be formed having a functional relation with the image density of developed silver.

The above-described method of forming an image having a functional relation with the density of silver image may be classified into an image formation method using a preformed dye and a color development method.

When the image formation method using a preformed dye is used in the present invention, the function for development of silver halide may be a method of releasing a water-soluble dye from a non-diffusible compound and achromatizing the released dye or dissolving out the released dye into the processing solution. In this case, the dye not released but remained in the light-sensitive material participates in the image formation and in order to reinforce the silver image, the compounds in a group generally called a positive action compound are preferably used. This method is described in U.S. Pat. No. 4,139,379, British Patent 11445 and JP-A-62-215270. In this method, an auxiliary developing agent such as a phenidone may be used, if desired.

The color development method which is most preferably used in the present invention is described in detail below. Known examples of the color development method include a method where a dye reductant reduces silver halide upon development to form a dye, a method where a reducing agent reduces silver halide and the resulting product makes self-coupling reaction to form a dye, and a method where a color developing agent and a coupler are used and a dye is formed by coupling reaction of an oxidation product of the developing agent produced by the development with the coupler. In these methods, an auxiliary developing agent such as phenidones may be used, if desired.

Examples of the method of reducing silver halide by a dye reductant to form a dye include the methods described in U.S. Pat. Nos. 3,579,342, 4,022,617, 4,374,921 and 4,865,958, JP-A-57-84447, JP-A-63-172264, JP-A-63-187233, JP-A-2-32332 and JP-A-4-52452.

Examples of the method of reducing silver halide by a reducing agent and forming a dye by the oxidation product produced by itself or by the self-coupling reaction of the oxidation product within the molecule include the methods described in British Patents 1,122,085 and 1,210,417, U.S. Pat. No. 3,615,509 and Belgian Patent 874,605.

The method of using a color developing agent and a coupler and forming a dye upon coupling reaction of an oxidation product of the developing agent produced upon development with the coupler is most preferably used in the present invention. Preferred examples of the color developing agent for use in the dye image formation method using a color developing agent of the present invention include those described in West German Patent 1,158,836, British Patent 2,018,453, U.S. Pat. Nos. 3,734,735 and 3,809,906, JP-A-47-37539, JP-A-52-42725, JP-A-52-57827, JP-A-54-31737, U.S. Pat. No. 4,126,461, JP-B-63-36487, JP-A-58-33238, JP-A-59-53831, JP-B-2-4890, JP-B-3-60418, JP-B-4-20177, JP-B-5-48901, JP-B-5-48902, JP-B-4-69776, JP-A-60-181742, JP-A-60-191251, JP-A-62-227141, JP-A-62-288835, JP-A-3-15052, JP-A-3-33743, JP-A-3-125145, JP-A-5-224381, JP-A-49-46427, JP-B-2-15855, JP-B-2-15856, JP-A-59-111148, U.S. Pat. No. 4,430,420, JP-B-46-7782, JP-B-45-9031, Belgian Patent 602,250, U.S. Pat. No. 3,357,203, JP-B-48-39165, JP-B-3-74817, JP-A-62-131253, JP-B-5-33781, JP-B-5-33782, JP-A-63-8645, JP-A-63-123043, JP-A-63-123044, JP-A-63-123045 and JP-A-63-123046. In particular, a method of using at least one color developing agent represented by the following formula (I), (II) or (III) is preferred. The color developing agent is added to the light-sensitive material but further may be present in the developer.

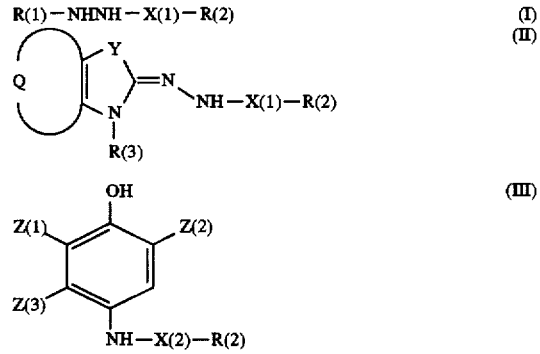

wherein R(1) represents an aryl group; X(1) represents a carbonyl group, a sulfonyl group or a phosphoryl group; R(2) represents an alkyl group, an aryl group, an arylamino group, an alkylamino group, an aryloxy group or an alkoxy group; Q represents a nonmetallic atom group necessary for forming a ring by condensing to the heterocyclic ring in formula (II); Y represents an oxygen atom, a sulfur atom or =N—R(3); R(3) represents an alkyl group or an aryl group; Z(1) to Z(3) each represents an alkyl group, an alkenyl group, an alkynyl group, an aryl group, an acyloxy group, a carbamoyloxy group, a carbonamido group, a sulfonamido group, a carbamoyl group, a sulfamoyl group, an alkoxy group, an aryloxy group, an alkoxycarbonyl group, an N-acylsulfamoyl group, an alkylsulfonyl group, an arylsulfonyl group, an alkoxycarbonylamino group, an aryloxycarbonylamino group, an amino group, a cyano group, a nitro group, a carboxyl group, a hydroxy group, a sulfo group, a mercapto group, an alkylsulfinyl group, an arylsulfonyl group, an alkylthio group, an arylthio group, a ureido group, a heterocyclic group, an acyl group, a sulfamoylamino group, a silyl group or a halogen atom (e.g., fluorine, chlorine, bromine); and X(2) represents a sulfonyl group.

The groups are described in greater detail below. The aryl group represented by R(1) includes a heteroaryl ring or a benzene ring which may be condensed to other ring, each substituted by a substituent having a positive Hammett's substituent constant$\sigma_p$ value such as a cyano group, a sulfonyl group, a sulfinyl group, a sulfamoyl group, a carbamoyl group, an alkoxycarbonyl group, an aryloxycarbonyl group, an acyl group, a trifluoromethyl group, a halogen atom, an acyloxy group, an acylthio group or a heterocyclic group. When R(1) represents a benzene ring which may be condensed to other ring, the total of the Hammett's substituent constant$\sigma_p$ values of the substituents on the benzene ring is preferably from 0.8 to 3.0, more preferably from 1.2 to 2.5.

X(1) represents a carbonyl group, a sulfonyl group or a phosphoryl group, preferably a carbonyl group or a sulfonyl group.

R(2) represents an alkyl group (including a linear or branched, chained or cyclic alkyl group having from 1 to 50 carbon atoms, e.g., trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl; a linear or branched, chained or cyclic alkenyl group having from 2 to 50 carbon atoms, e.g., vinyl, 1-methylvinyl, cyclohexen-1-yl; and an alkynyl group having a total carbon number of from 2 to 50, e.g., ethynyl, 1-propynyl), an aryl group (including an aryl group having from 6 to 50 carbon atoms and a heteroaryl group having from 1 to 50 carbon atoms, e.g., phenyl, naphthyl, anthryl, 2-pyridyl, 2-pyrazyl), an arylamino group (including an arylamino group having from 6 to 50 carbon atoms and a heteroarylamino group having from 1 to 50 carbon atoms, e.g., anilino, 2-chloro-5-dodecyloxycarbonylphenylamino, 2-pyridylamino, 4-butoxyphenylamino, 2-benzothiazolylamino), an alkylamino group (including an amino group having from 0 to 50 carbon atoms, e.g., amino, methylamino, diethylamino, diisopropylamino, isopropylamino, octylamino, dodecylamino, dodecyloxypropylamino, morpholino), an aryloxy group (including an aryloxy group having from 6 to 50 carbon atoms, e.g., phenoxy, 4-methoxyphenoxy, naphthoxy) or an alkoxy group (including an alkoxy group having from 1 to 50 carbon atoms, e.g., methoxy, propoxy, isopropoxy, octyloxy, t-octyloxy, dodecyloxy, 2-(2,4-di-t-pentylphenoxy)ethoxy).

R(2) preferably represents an alkyl group, an aryl group, an arylamino group or an alkylamino group, more preferably, when X(1) is a carbonyl group, an arylamino or alkylamino group having at least one hydrogen atom on the nitrogen atom, and when X(1) is a sulfonyl group, an alkyl group or an aryl group.

Q represents a nonmetallic atom group necessary for forming a ring by condensing to a 5-membered heterocyclic ring adjacent thereto, preferably for forming a 5-, 6-, 7- or 8-membered ring, more preferably for forming a 6-membered hydrocarbon ring. The ring constituted by Q may have a substituent. Examples of the substituent include a linear or branched, chained or cyclic alkyl group having from 1 to 50 carbon atoms (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl), a linear or branched, chained or cyclic alkenyl group having from 2 to 50 carbon atoms (e.g., vinyl, 1-methylvinyl, cyclohexen-1-yl), an alkynyl group having a total carbon number of from 2 to 50 (e.g., ethynyl, 1-propynyl), an aryl group having from 6 to 50 carbon atoms (e.g., phenyl, naphthyl, anthryl), an acyloxy group having from 1 to 50 carbon atoms (e.g., acetoxy, tetradecanoyloxy, benzoyloxy), a carbamoyloxy group having from 1 to 50 carbon atoms (e.g., N,N-dimethylcarbamoyloxy), a carbonamido group having from 1 to 50 carbon atoms (e.g., formamido, N-methylacetamido, acetamido, N-methylformamido, benzamido), a sulfonamido group having from 1 to 50 carbon atoms (e.g., methanesulfonamido, dodecanesulfonamido, benzenesulfonamido, p-toluenesulfonamido), a carbamoyl group having from 1 to 50 carbon atoms (e.g., N-methylcarbamoyl, N,N-diethylcarbamoyl, N-mesylcarbmoyl), a sulfamoyl group having from 0 to 50 carbon atoms (e.g., N-butylsulfamoyl, N,N-diethylsulfamoyl, N-methyl-N-(4-methoxyphenyl) sulfamoyl), an alkoxy group having from 1 to 50 carbon atoms (e.g., methoxy, propoxy, isopropoxy, octyloxy, t-octyloxy, dodecyloxy, 2-(2,4-di-t-pentylphenoxy)ethoxy), an aryloxy group having from 6 to 50 carbon atoms (e.g., phenoxy, 4-methoxyphenoxy, naphthoxy), an aryloxycarbonyl group having from 7 to 50 carbon atoms (e.g., phenoxycarbonyl, naphthoxycarbonyl), an alkoxycarbonyl group having from 2 to 50 carbon atoms (e.g., methoxycarbonyl, t-butoxycarbonyl), an N-acylsulfamoyl group having from 1 to 50 carbon atoms (e.g., N-tetradecanoylsulfamoyl, N-benzoyl-sulfamoyl), an alkylsulfonyl group having from 1 to 50 carbon atoms (e.g., methanesulfonyl, octylsulfonyl, 2-methoxyethylsulfonyl, 2-hexyldecylsulfonyl), an arylsulfonyl group having from 6 to 50 carbon atoms (e.g., benzenesulfonyl, p-toluenesulfonyl, 4-phenylsulfonyl-phenylsulfonyl), an alkoxycarbonylamino group having from 2 to 50 carbon atoms (e.g., ethoxycarbonylamino), an aryloxycarbonylamino group having from 7 to 50 carbon atoms (e.g., phenoxycarbonylamino, naphthoxycarbonylamino), an amino group having from 0 to 50 carbon atoms (e.g., amino, methylamino, diethylamino, diisopropylamino, anilino, morpholino), a cyano group, a nitro group, a carboxyl group, a hydroxy group, a sulfo group, a mercapto group, an alkylsulfinyl group having from 1 to 50 carbon atoms (e.g., methanesulfinyl, octanesulfinyl), an arylsulfinyl group having from 6 to 50 carbon atoms (e.g., benzenesulfinyl, 4-chlorophenylsulfinyl, p-toluenesulfinyl), an alkylthio group having from 1 to 50 carbon atoms (e.g., methylthio, octylthio, cyclohexylthio), an arylthio group having from 6 to 50 carbon atoms (e.g., phenylthio, naphthylthio), a ureido group having from 1 to 50 carbon atoms (e.g., 3-methylureido, 3,3-dimethylureido, 1,3-diphenylureido), a heterocyclic group having from 2 to 50 carbon atoms (including 3- to 12-membered monocyclic or condensed rings containing at least one of nitrogen, oxygen and sulfur as a hetero atom, e.g., 2-furyl, 2-pyranyl, 2-pyridyl, 2-thienyl, 2-imidazolyl, morpholino, 2-quinolyl, 2-benzimidazolyl, 2-benzothiazolyl, 2-benzoxazolyl), an acyl group having from 1 to 50 carbon atoms (e.g., acetyl, benzoyl, trifluoroacetyl), a sulfamoylamino group having from 0 to 50 carbon atoms (e.g., N-butylsulfamoylamino, N-phenylsulfamoylamino), a silyl group having from 3 to 50 carbon atoms (e.g., trimethylsilyl, dimethyl-t-butylsilyl, triphenylsilyl), a halogen atom (e.g., fluorine, chlorine, bromine) and a nitro group. The substituent represented by R(2) may also be substituted by the above-described substituent.

Y represents an oxygen atom, a sulfur atom or =N—R (3). Y is preferably >N—R(3). R(3) represents an alkyl group or an aryl group and specific examples thereof include those described for R(2) and the substituent on Q.

Specific examples of Z(1) to Z(3) include those described for the substituent on Q. X(2) represents a sulfonyl group.

Specific examples of the compounds represented by formulae (I), (II) and (III) are set forth below, however, the scope of the present invention is by no means limited to these specific examples.

(1)

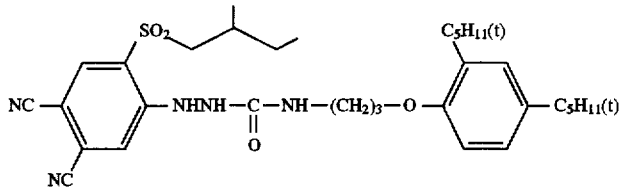

(2)

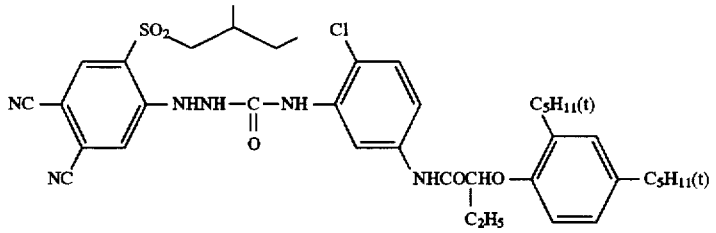

(3)

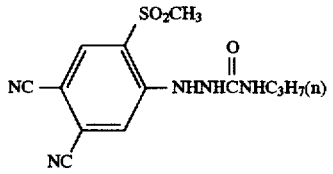

(4)

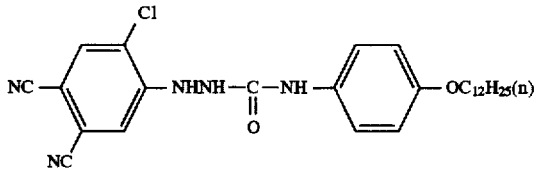

(5)

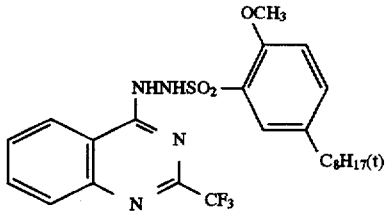

(6)

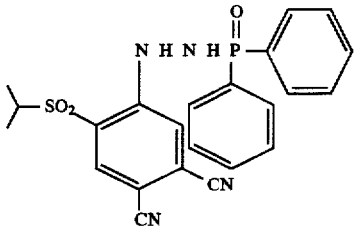

(7)

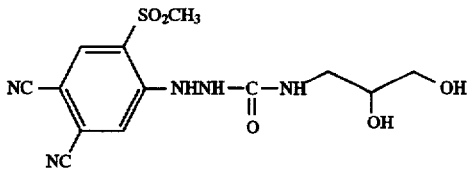

-continued
(8)
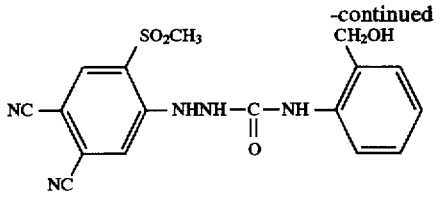
(9)
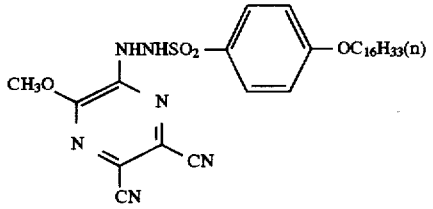
(10)
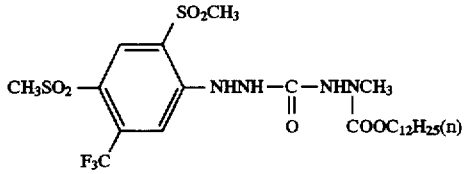
(11)
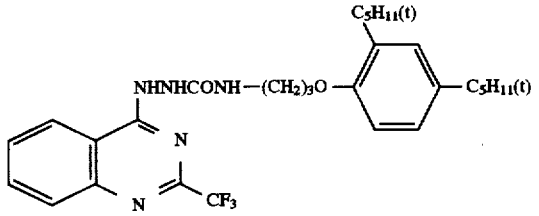
(12)
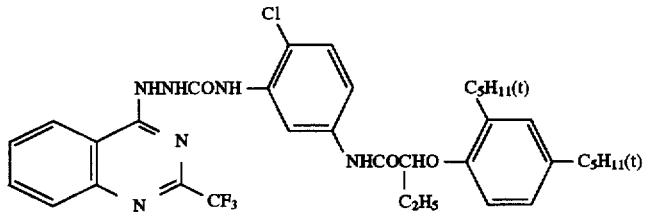
(13)
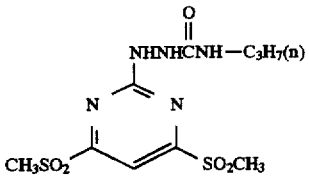
(14)
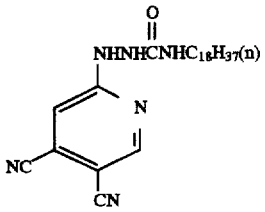
(15)
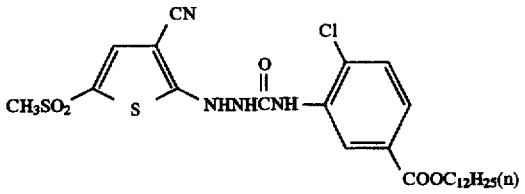

-continued
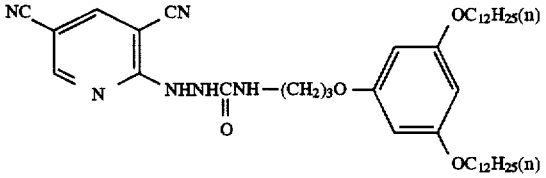
(16)
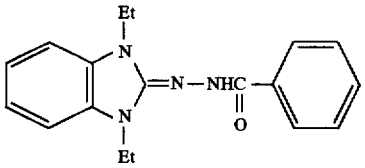
(17)
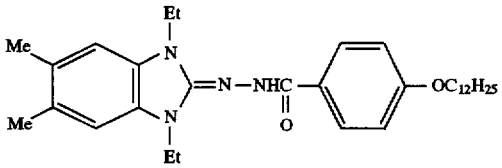
(18)
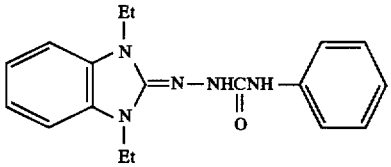
(19)
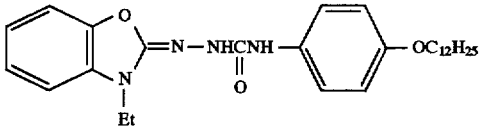
(20)
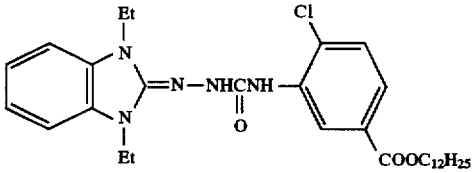
(21)
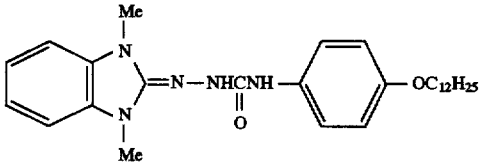
(22)
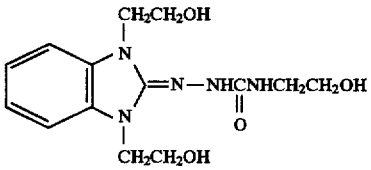
(23)
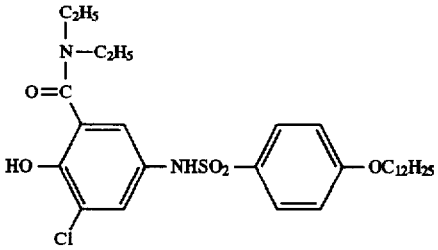
(24)

-continued (25)

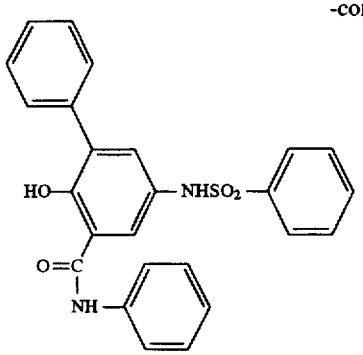

(26)

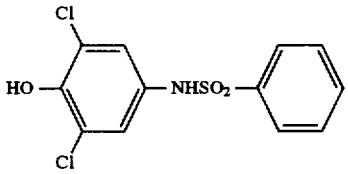

(27)

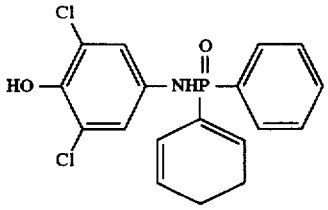

(28)

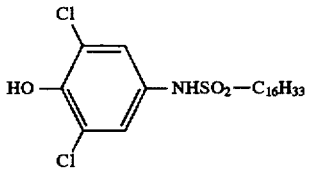

(29)

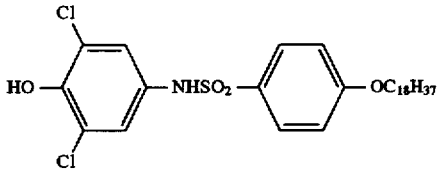

Representative synthetic examples of the compound for use in the present invention are described below. Other compounds can also be synthesized by referring to the following synthesis examples.

Synthesis of the compound represented by formula (I) is described below.

SYNTHESIS EXAMPLE 1

Synthesis of Compound (3)

Compound (3) was synthesized through the following synthesis route.

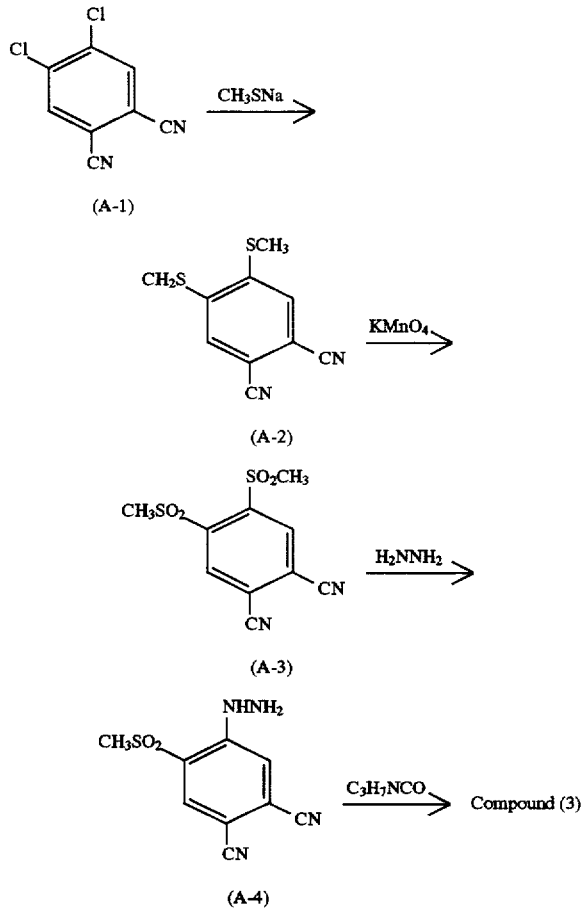

Synthesis of Compound (A-2)

In 1.1 P of N,N-dimethylformamido (DMF), 53.1 g of 1,2-dichloro-4,5-dicyanobenzene (A-1) (CAS Registry No. 139152-08-2) was dissolved, and thereto 268 g of an aqueous solution (15%) of methylmercaptan sodium salt was added dropwise at room temperature over 1 hour, followed by stirring at 60° C. for 1 hour. The reaction solution was cooled to room temperature, poured into water and stirred for 30 minutes. The produced white solids were collected by filtration, washed with water and dried. Yield by weight: 46.5 g. Yield: 78.1%.

Synthesis of Compound (A-3)

In 400 ml of acetic acid, 41.1 g of Compound (A-2) was suspended, and thereto 89.3 g of potassium permanganate dissolved in 400 ml of water was added dropwise under water cooling over 1 hour. The mixed solution was allowed to stand at room temperature over night and after adding thereto 2 l of water and 2 l of ethyl acetate, subjected to sellaite filtration. The filtrate was separated and the organic layer was washed with water, an aqueous solution of sodium hydrosulfite, aqueous sodium dicarbonate and brine, dried over anhydrous magnesium sulfate and filtered. Then, the solvent was distilled off and the residue was crystallized by adding thereto a mixed solvent of ethyl acetate and hexane to obtain 29.4 g of Compound (A-3) as a white solid. Yield: 55.0%.

Synthesis of Compound (A-4)

In 200 ml of dimethylsulfoxide (DMSO), 29.4 g of Compound (A-3) was dissolved, and thereto 8.7 g of hydrazine monohydrate was added dropwise under water cooling over 15 minutes, followed by stirring for 10 minutes under water cooling. The reaction solution was poured into water and the produced yellow solids were collected by filtration, washed with water and dried. Yield by weight: 17.4 g. Yield: 70.9%.

Synthesis of Compound (5)

In 50 ml of tetrahydrofurane, 11.8 g of Compound (A-4) was dissolved, and thereto 4.7 g of propylisocyanate was added dropwise at room temperature over 30 minutes, followed by stirring for 1 hour. The reaction mixture was poured into water and extracted with ethyl acetate. The organic layer was washed with aqueous hydrochloric acid and brine, dried over anhydrous magnesium sulfate and filtered, and then, the solvent was distilled off. The residue was recrystallized from a mixed solvent of ethyl acetate-hexane (1:10) to obtain 14.5 g of Compound (5) as a white solid. Yield: 90.2%.

SYNTHESIS EXAMPLE 2

Synthesis of Compound (2)

Compound (2) was synthesized through the following synthesis route.

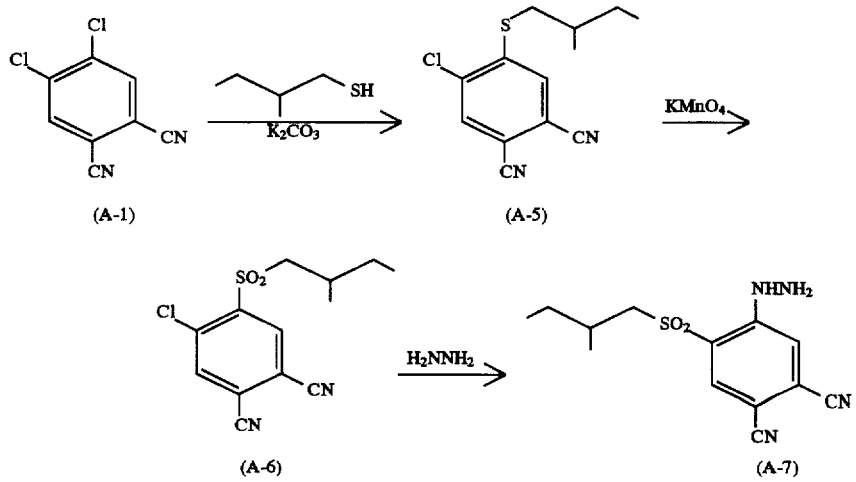

-continued

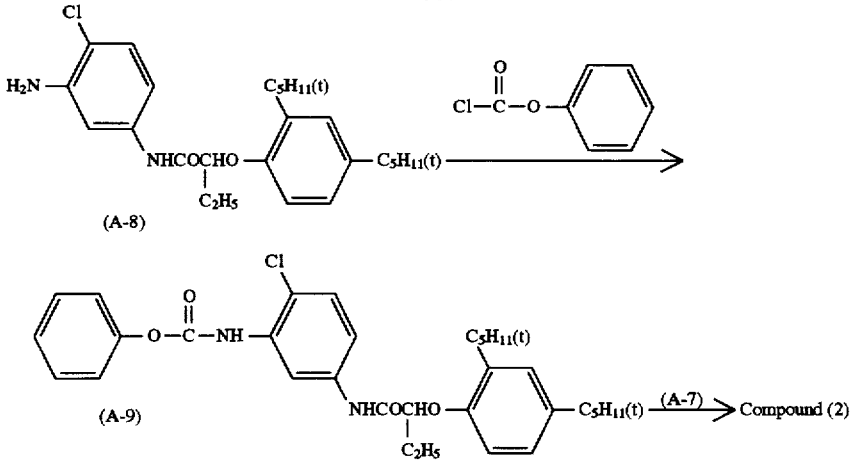

Synthesis of Compound (A-5)

In 600 ml of DMF, 84.7 g of Compound (A-1) and 89.8 g of potassium carbonate were suspended, and thereto 60.3 ml of 2-methylbutylmercaptan was added dropwise at room temperature over 1 hour, followed by stirring at room temperature for 1 hour. The reaction mixture was poured in water and stirred for 10 minutes. The produced white solids were collected by filtration, washed with water and dried. Yield by weight: 100.8 g. Yield: 88.5%.

Synthesis of Compound (A-6)

In 500 ml of acetic acid and 500 ml of water, 98.0 g of Compound (A-5) was suspended, and thereto 88.5 g of potassium permanganate dissolved in 500 ml of water was added at room temperature over 1 hour, followed by stirring at room temperature for 2 hours. After adding thereto 2 l of water and 2 l of ethyl acetate, the mixed solution was subjected to sellaite filtration. The filtrate was separated and the organic layer was washed with water, an aqueous solution of hydrosulfite, aqueous sodium dicarbonate and brine, dried over anhydrous magnesium sulfate and filtered. Then, the solvent was distilled off and the residue was crystallized by adding thereto isopropyl alcohol to obtain 53.2 g of Compound (A-6) as a white solid. Yield: 48.4%.

Synthesis of Compound (A-7)

In 100 ml of DMSO, 50.5 g of Compound (A-6) was dissolved, and thereto 17.0 g of hydrazine monohydrate was added dropwise under ice cooling over 10 minutes, followed by stirring at room temperature for 30 minutes. The reaction solution was poured into water and extracted with ethyl acetate. The organic layer was washed with water, dried over anhydrous magnesium sulfate and filtered. Then, the solvent was distilled off and the residue was purified in a silica gel chromatography. Methylene chloride was used as an eluent. The resulting solution was crystallized from ethyl acetate-hexane (1:2) to obtain 31.4 g of Compound (A-7) as a yellow solid. Yield: 63.2%.

Synthesis of Compound (A-9)

In 500 ml of ethyl acetate, 44.5 g of Compound (A-8) (CAS Registry No. 51461-11-1) was dissolved, and thereto 500 ml of water having dissolved therein 25 g of sodium bicarbonate was added. To the resulting solution, 16.4 g of phenyl chlorocarbonate was added dropwise at room temperature over 30 minutes and then stirred for 1 hour. The reaction mixture was separated and the organic layer was washed with brine, dried over anhydrous magnesium sulfate, and filtered. Then, the solvent was distilled off to obtain 54.0 g of Compound (A-9) as a light yellow oily product. Yield: 95.6%.

Synthesis of Compound (2)

In 100 ml of acetonitrile, 5.8 g of Compound (A-7), 11.3 g of Compound (A-9) and 0.60 g of DMAP (N,N-dimethylaminopyridine) were dissolved and the mixed solution was stirred at 60° C. for 3 hours. The reaction mixture was poured into water and extracted with ethyl acetate. The organic layer was washed with aqueous sodium bicarbonate, aqueous hydrochloric acid and brine, dried over anhydrous magnesium sulfate and filtered, and then, the solvent was distilled off. The residue was purified in a silica gel column chromatography (eluent: ethyl acetate/hexane=½) and crystallized from hexane to obtain 8.0 g of Compound (2) as a white solid. Yield: 52.4%.

SYNTHESIS EXAMPLE 3

Synthesis of Compound (1)

Compound (1) was synthesized through the following synthesis route.

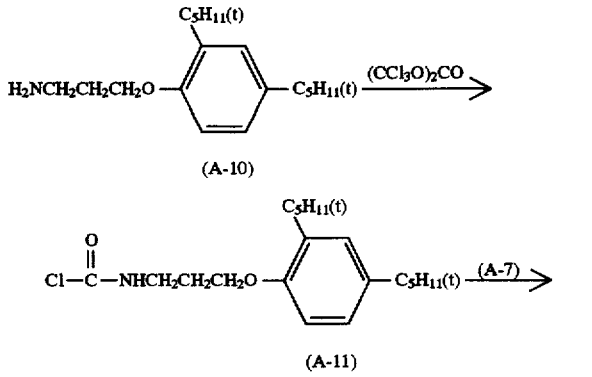

Synthesis of Compound (1)

In 100 ml of THF, 4.6 g of triphosgene was dissolved and thereto 13.6 g of Compound (A-10) (CAS Registry No. 61053-26-7) was added dropwise at room temperature over 10 minutes. Further, thereto 18.7 ml of triethylamine was added dropwise at room temperature over 10 minutes. The mixed solution was allowed to react for 30 minutes to obtain a solution of Compound (A-11). To the resulting reaction solution, 13.0 g of Compound (A-7) was added by installments at room temperature over 10 minutes. After stirring for 1 hour, the mixed solution was poured into water and extracted with ethyl acetate. The organic layer was washed with aqueous sodium bicarbonate, aqueous hydrochloric acid and brine, dried over anhydrous magnesium sulfate and filtered, and then, the solvent was distilled off. The residue was purified in a silica gel column chromatography and recrystallized from a mixed solution of ethyl acetate/hexane (1/10) to obtain Compound (1) as a white solid. Yield by weight: 17.0 g. Yield: 61.3%.

SYNTHESIS EXAMPLE 4

Synthesis of Compound (12)

Compound (12) was synthesized through the following synthesis route.

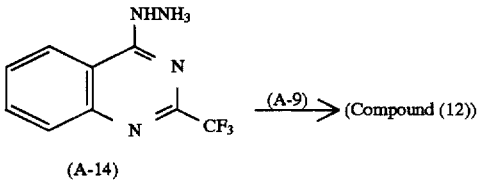

The synthesis was performed in the same manner as in Synthesis Example 2 except for using 6.0 g of Compound (A-14) (described in EP 0545491A1), 14.98 g of Compound (A-9) and 0.5 g of DMAP, and as a result Compound (12) was obtained as a white solid. Yield by weight: 12.0 g. Yield: 65.3%.

SYNTHESIS EXAMPLE 5

Synthesis of Compound (11)

The synthesis was performed in the same manner as in Synthesis Example 3 except for using Compound (A-11) prepared from 5.8 g of Compound (A-10) in the same manner as in Synthesis Example 3 and 4.3 g of Compound (A-14) and as a result, Compound (11) was obtained as a white solid. Yield by weight: 6.7 g. Yield: 61.5%.

The synthesis method of the compound represented by formula (II) is described below. The compound represented by formula (II) can be synthesized according to, for example, the method described in *Liebich Analene Der Huemi*, Vol. 609, p. 169 (1957). Further, the following synthesis methods or methods in accordance thereto may also be used.

SYNTHESIS EXAMPLE 6

Synthesis of Compound (17)

To 80 ml of ethanol, 18 g of Compound (a) and 6.9 g of Compound (b) were added and the mixture was heated under reflux for 3 hours while stirring. After allowing to cool, about 2N of aqueous ammonia was poured thereinto and the solution was extracted with ethyl acetate. The extract was washed with brine, dried and concentrated. The residue was recrystallized from ethyl acetate and hexane to obtain 7.2 g of Compound (17). The chemical structure of the compound was verified by NMR, IR and MS spectra.

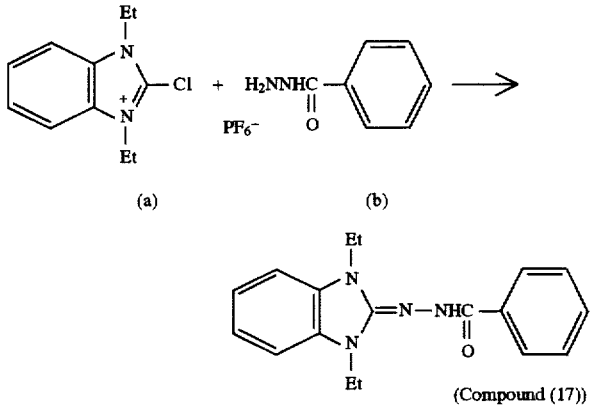

SYNTHESIS EXAMPLE 7

Synthesis of Compound (21)

To 80 ml of ethanol, 7.1 g of Compound (a) and 8.0 g of Compound (c) were added and the mixed solution was heated under reflux for 4 hours while stirring. After allowing to cool, about 2N of aqueous ammonia was poured thereinto and the mixed solution was extracted with ethyl acetate. The extract was washed with brine, dried and concentrated. The residue was recrystallized from methanol to obtain 8.5 g of Compound (21). The chemical structure of the compound was verified by NMR, IR and MS spectra.

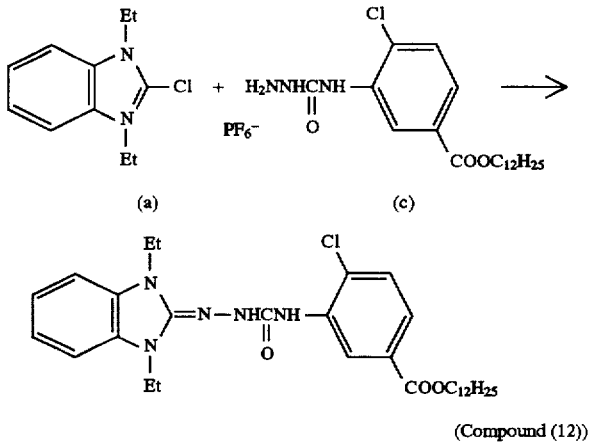

The synthesis method of the compound represented by formula (III) is described below. The compound represented by formula (III) can be simply synthesized usually by the reaction of a para-aminophenol derivative with a sulfonyl halide. With respect to this synthesis method, the synthesis method described in JP-B-5-48902 may be used.

The coupler for use in combination with the above-described color developing agent in the present invention is described below.

The color developing agent for use in the present invention is used in combination with a compound (coupler) which forms a dye upon oxidation coupling reaction. The coupler may be either a four-equivalent coupler or a two-equivalent coupler, but the two-equivalent coupler is preferred in many cases. Specific examples of the four-equivalent coupler and the two-equivalent coupler are described in detail in T. H. James, *The Theory of the*

*Photographic Process*, 4th ed., Macmillan (1977), pp. 291–334 and pp. 354–361, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Examples of the coupler which is preferably used in the present invention are described below.

The coupler which is preferably used in the present invention includes compounds having structures represented by the following formulae (1) to (12). These compounds each is a compound generally called active methylene, pyrazolone, pyrazoloazole, phenol, naphthol or pyrrolotriazole and all are known in the art.

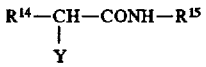
(1)

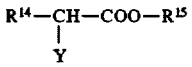
(2)

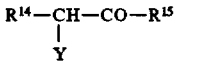
(3)

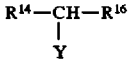
(4)

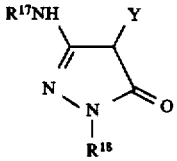
(5)

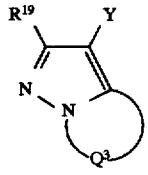
(6)

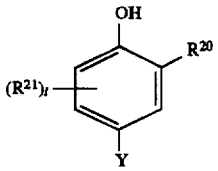
(7)

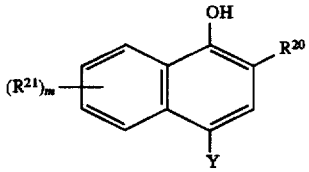
(8)

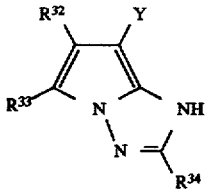
(9)

-continued

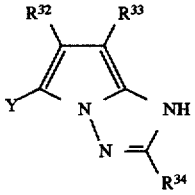
(10)

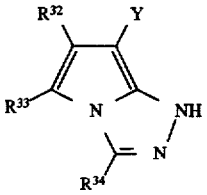
(11)

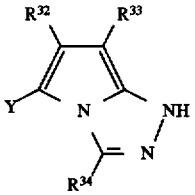
(12)

The compounds represented by formulae (1) to (4) are couplers called an active methylene-base coupler and in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkyl sulfonyl group or an arylsulfonyl group, which groups each may have a substituent.

In formulae (1) to (3), $R^{15}$ represents an alkyl group, an aryl group or a heterocyclic residue, which groups each may have a substituent. In formula (4), $R^{16}$ represents an aryl group or a heterocyclic residue, which groups each may have a substituent. Examples of the substituent on $R^{14}$, $R^{15}$ or $R^{16}$ include those described above for the substituent on Q.

In formulae (1) to (4), Y represents a hydrogen atom or a group capable of splitting off upon coupling reaction with an oxidation product of the developing agent. Examples of Y include a heterocyclic group (including saturated or unsaturated 5-, 6- or 7-membered monocyclic or condensed ring containing at least one of nitrogen, oxygen and sulfur as a hetero atom, e.g., succinimido, maleinimido, phthalimido, diglycolimido, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrrolin-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-amino-1,3,4-thiazolidine-4-one), a halogen atom (e.g., chlorine, bromine), an aryloxy group (e.g., phenoxy, 1-naphthoxy), a heterocyclic oxy group (e.g, pyridyloxy, pyrazolyloxy), an acyloxy group (e.g., acetoxy, benzoyloxy), an alkoxy group (e.g., methoxy, dodecyloxy), a carbamoyloxy group (e.g., N,N-diethylcarbamoyloxy, morpholinocarbonyloxy), an aryloxycarbonyloxy group (e.g., phenoxycarbonyloxy), an alkoxycarbonyloxy (e.g., methoxycarbonyloxy, ethoxycarbonyloxy), an arylthio group (e.g., phenylthio, naphthylthio), a heterocyclic thio group (e.g., tetrazolylthio, 1,3,4-thiadiazolylthio, 1,3,4-oxadiazolylthio, benzimidazolylthio), an alkylthio group (e.g., methylthio, octylthio, hexadecylthio), an alkylsulfonyloxy group (e.g., methanesulfonyloxy), an arylsulfonyloxy group (e.g., benzenesufonyloxy, toluenesulfonyloxy), a carbonamido group (e.g., acetamide, trifluoroacetamido), a sulfonamido group (e.g., methanesulfonamido, benzenesulfonamido), an alkylsulfonyl group (e.g., methanesulfonyl), an arylsulfonyl group (e.g., benzenesulfonyl), an alkylsulfinyl group (e.g., methanesulfinyl), an arylsulfinyl group (e.g., benzenesulfinyl), an arylazo group (e.g., phenylazo, naphthylazo) and a carbamoylamino group (e.g., N-methylcarbamoylamino).

Y may be substituted by a substituent and examples of the substituent on Y include those described above for the substituent on Q.

Y is preferably a halogen atom, an aryloxy group, a heterocyclic oxy group, an acyloxy group, an aryloxycarbonyloxy group, an alkoxycarbonyloxy group or a carbamoyloxy group.

In formulae (1) to (4), $R^{14}$ and $R^{15}$ or $R^{14}$ and $R^{16}$ may be combined with each other to form a ring.

The coupler represented by formula (5) is called a 5-pyrazolone-base coupler. In formula (5), $R^{17}$ represents an alkyl group, an aryl group, an acyl group or a carbamoyl group, and $R^{18}$ represents a phenyl group or a phenyl group substituted by one or more of a halogen atom, an alkyl group, a cyano group, an alkoxy group, an alkoxycarbonyl group and an acylamino group.

Among 5-pyrazolone-base couplers represented by formula (5), preferred are those where $R^{17}$ is an aryl group or an acyl group and $R^{18}$ is a phenyl group substituted by one or more halogen atom.

Preferred embodiments of these groups are described in detail below. $R^{17}$ is preferably an aryl group such as a phenyl group, a 2-chlorophenyl group, a 2-methoxyphenyl group, a 2-chloro-5-tetradecanamidophenyl group, a 2-chloro-5-(3-octadecenyl-1-succinimido)phenyl group, a 2-chloro-5-octadecylsulfonamidophenyl group and 2-chloro-5-[2-(4-hydroxy-3-t-butylphenoxy)tetradecanamido]-phenyl group, or an acyl group such as an acetyl group, a 2-(2,4-di-t-pentylphenoxy)butanoyl group, a benzoyl group and a 3-(2,4-di-t-amylphenoxyacetamido)benzoyl group, which groups each may have a substituent. Examples of the substituent include an organic substituent or a halogen atom bonded at the carbon atom, the oxygen atom, the nitrogen atom or the sulfur atom. Y has the same meaning as described above in detail.

$R^{18}$ is preferably a substituted phenyl group such as a 2,4,6-trichlorophenyl group, a 2,5-dichlorophenyl group and a 2-chlorophenyl group.

The coupler represented by formula (6) is called a pyrazoloazole-base coupler. In formula (6), $R^{19}$ represents a hydrogen atom or a substituent and $Q^3$ represents a nonmetallic atom group necessary for forming a 5-membered azole ring containing from 2 to 4 nitrogen atoms. The azole ring may have a substituent (including a condensed ring).

Among the pyrazoloazole-base couplers represented by formula (6), in view of spectral absorption property of the colored dye, preferred are imidazo[1,2-b]pyrazoles described in U.S. Pat. No. 4,500,630, pyrazolo[1,5-b]-1,2,4-triazoles described in U.S. Pat. No. 4,500,654 and pyrazolo[5,1-c]-1,2,4-triazoles described in U.S. Pat. No. 3,725,067.

The substituent represented by $R'^9$ and the azole ring represented by $Q^3$ are described in detail, for example, in U.S. Pat. No. 4,540,654, from column 2, line 41 to column 8, line 27. Preferred examples of the pyrazoloazole-base coupler include pyrazoloazole couplers having a branched alkyl group directly bonded to the 2-, 3- or 6-position of the pyrazolotriazole group as described in JP-A-61-65245, pyrazoloazole couplers containing a sulfonamido group within the molecule as described in JP-A-61-65245, pyrazoloazole couplers having an alkoxyphenylsulfonamido ballast group as described in JP-A-61-147254, pyrazolotriazole couplers having an alkoxy group or an aryloxy group at the 6-position as described in JP-A-62-209457 and JP-A-63-307453, and pyrazolotriazole couplers having a carbonamido group within the molecule as described in JP-A-2-201443. Y has the same meaning as described above.

The couplers represented by formulae (7) and (8) are called as a phenol-base coupler and a naphthol-base coupler, respectively. In the formulae (7) and (8), $R^{20}$ represents a hydrogen atom or a group selected from —$NHCOR^{22}$, —$SI_2NR^{22}R^{23}$, —$NHCOR^{22}$, —$NHCONR^{22}R^{23}$ and —$NHSO_2NR^{22}R^{23}$ (wherein $R^{22}$ and $R^{23}$ each represents a hydrogen atom or a substituent), $R^{21}$ represents a substituent, e represents an integer selected from 0 to 2, and m represents an integer selected from 0 to 4. Examples of the substituent of $R^{21}$ to $R^{23}$ include those described above for the substituents of $R^{14}$ to $R^{16}$. Y has the same meaning as described above.

Preferred examples of the phenol-base coupler represented by formula (7) include 2-acylamino-5-alkylphenol-base couplers described in U.S. Pat. Nos. 2,369,929, 2,801,171, 2,772,162, 2,895,826 and 3,772,002, 2,5-diacylaminophenol-base couplers described in U.S. Pat. Nos. 2,772,162, 3,758,308, 4,126,396, 4,334,011 and 4,327,173, West German Patent Application (OLS) No. 3,329,729 and JP-A-59-166956, and 2-phenylureido-5-acylaminophenol-base couplers described in U.S. Pat. Nos. 3,446,622, 4,333,999, 4,451,559 and 4,427,767. Y has the same meaning as described above.

Preferred examples of the naphthol coupler represented by formula (8) include 2-carbamoyl-l-naphthol-base couplers described in U.S. Pat. Nos. 2,474,293, 4,052,212, 4,146,396, 4,282,233 and 4,296,200, and 2-carbamoyl-5-amido-1-naphthol-base couplers described in U.S. Pat. No. 4,690,889. Y has the same meaning as described above.

The couplers represented by formulae (9) to (12) are called a pyrrolotriazole coupler. In formulae, $R^{32}$, $R^{33}$ and $R^{34}$ each represents a hydrogen atom or a substituent and Y has the same meaning as described above. Examples of the substituent of $R^{32}$, $R^{33}$ and $R^{34}$ include those described above for the substituents of $R^{14}$ to $R^{6}$. Preferred examples of the pyrrolotriazole-base couplers represented by formulae (9) to (12) include couplers where at least one of $R^{32}$ and $R^{33}$ is an electron-withdrawing group, described in European Patents 488248A1, 491197A1 and 545300. Y has the same meaning as described above.

In addition, couplers having a structure of condensed ring phenol, imidazole, pyrrole, 3-hydroxypyridine, active methylene, active methine, 5,5-condensed heterocyclic ring or 5,6-condensed heterocyclic ring may be used.

Examples of the condensed ring phenol-base coupler include the couplers described in U.S. Pat. Nos. 4,327,173, 4,564,586 and 4,904,575.

Examples of the imidazole-base coupler include the couplers described in U.S. Pat. Nos. 4,818,672 and 5,051,347.

Examples of the 3-hydroxypyridine-base coupler include the couplers described in JP-A-1-315736.

Examples of the active methylene- and the active methine-base couplers include the couplers described in U.S. Pat. Nos. 5,104,783 and 5,162,196.

Examples of the 5,5-condensed heterocyclic ring-base coupler include the pyrrolopyrazole-base couplers described in U.S. Pat. No. 5,164,289 and the pyrroloimidazole-base couplers described in JP-A-4-174429.

Examples of the 5,6-condensed heterocyclic ring-base coupler include the pyrazolopyrimidine-base couplers described in U.S. Pat. No. 4,950,585, pyrrolotriazine-base couplers described in JP-A-4-204730 and the couplers described in European Patent 556700.

In addition to the above-described couplers, the couplers described in West German Patent Nos. 3,819,051A and 3,823,049, U.S. Pat. Nos. 4,840,883, 5,024,930, 5,051,347 and 4,481,268, European Patents 304856A2, 329036, 354549A2, 374781A2, 379110A2 and 386930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732.

Specific examples of the coupler which can be used in the present invention are set forth below, however, the present invention is by no means limited thereto.

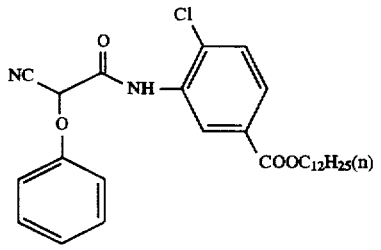

(C-1)

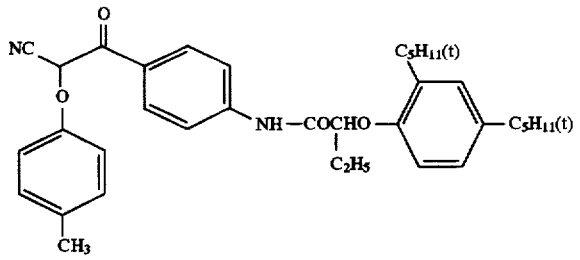

(C-2)

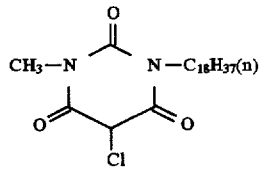

(C-3)

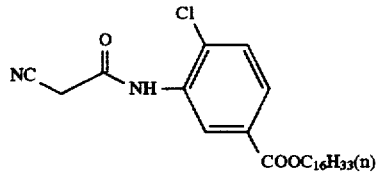

(C-4)

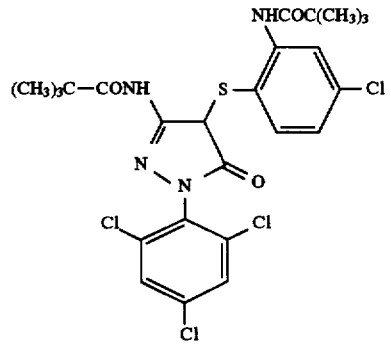

(C-5)

-continued
(C-6)
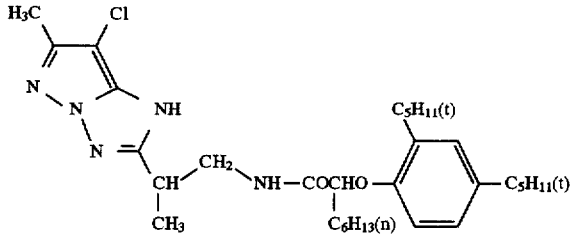
(C-7)
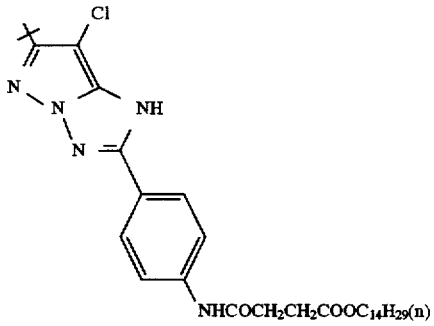
(C-8)
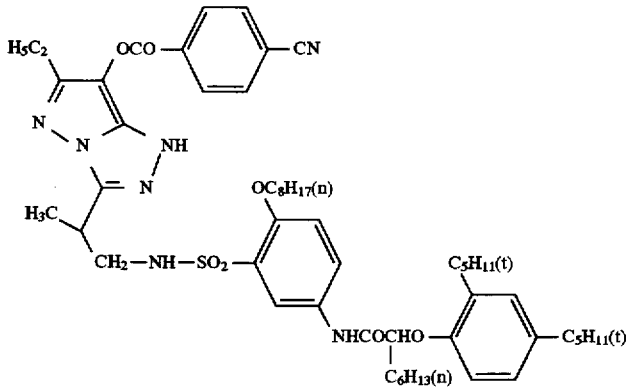
(C-9)
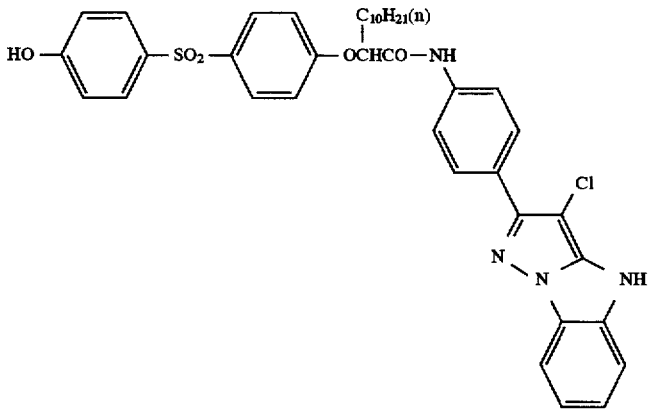
(C-10)
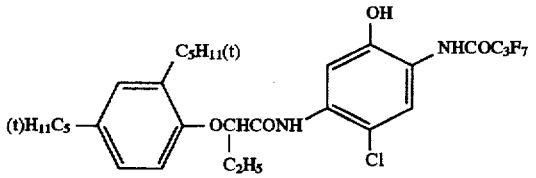

-continued
(C-11)
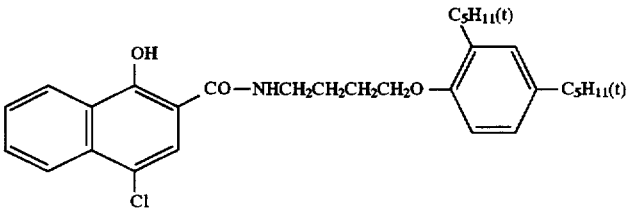
(C-12)
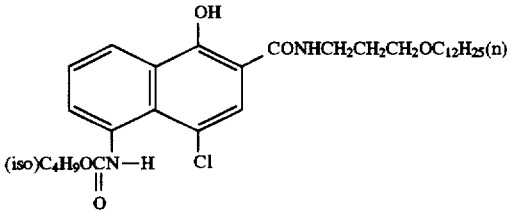
(C-13)
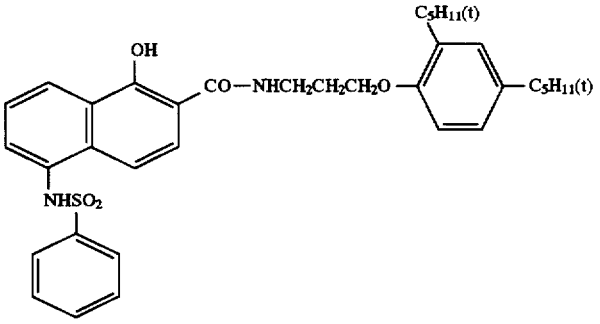
(C-14)
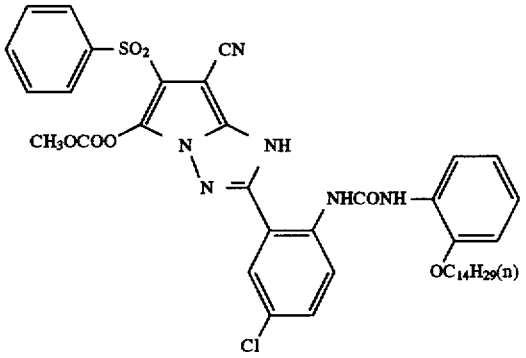
(C-15)
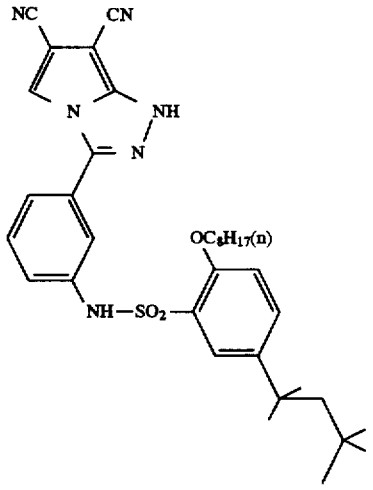

-continued

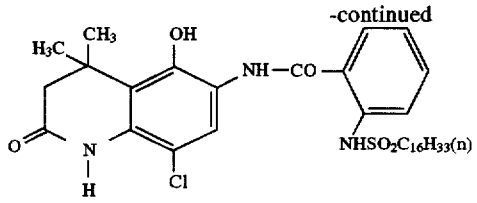

(C-16)

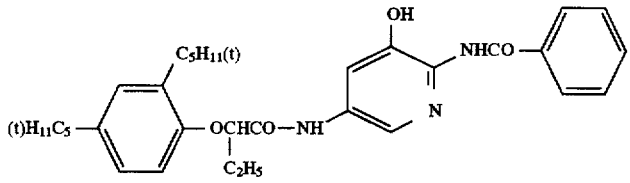

(C-17)

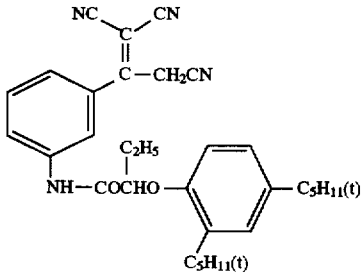

(C-18)

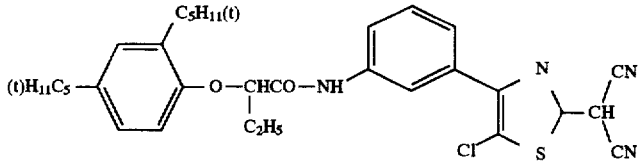

(C-19)

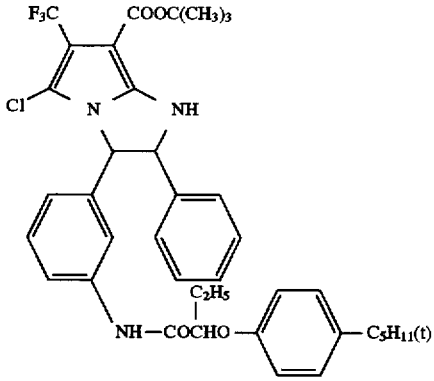

(C-20)

The addition amount of the coupler for use in the present invention varies depending upon the molar extinction coefficient (e) thereof, however, in order to obtain an image density of 1.0 or more in terms of reflection density, when the coupler produces a dye having of approximately from 5,000 to 500,000 upon coupling, the coating amount is suitably from 0.001 to 100 mmol/$m^2$, preferably from 0.01 to 10 mmol/$m^2$, more preferably approximately from 0.05 to 5 mmol/$m^2$.

The addition amount of the color developing agent for use in the present invention is from 0.01 to 100 times, preferably from 0.1 to 30 times, more preferably from 0.2 to 15 times the amount of the coupler. The developing agent for use in the present invention may be present in the emulsion layer. Alternatively, the developing agent may be present in a light-insensitive layer, as needed.

The compound which reacts with a developing agent or an oxidation product of the developing agent to form a dye image for use in the present invention is generally added to the emulsion layer.

In the present invention, an auxiliary developing agent is preferably used. The term "auxiliary developing agent" as used herein means a substance having a function of accelerating the transfer of electrons from the color developing agent to silver halide during the development in the silver halide development processing. The auxiliary developing agent for use in the present invention is preferably an electron-releasing compound according to Kendrew-Perutz's Law represented by formula (B-1) or (B-2). Among these, the compound represented by formula (B-1) is preferred.

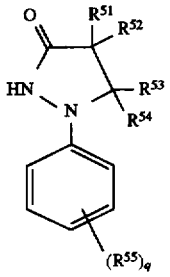

(B-1)

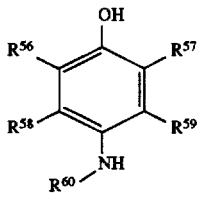

(B-2)

wherein $R^{51}$ to $R^{54}$ each represents a hydrogen atom, an alkyl group, a cycloalkyl group, an alkenyl group, an aryl group or a heterocyclic group.

$R^{55}$ to $R^{59}$ each represents a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an allenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamido group, a sulfamoylamino group, an alkylsulfinyl group, an allensulfinyl group, an alkanesulfonyl group, an allenesulfonyl group, a sulfamoyl group, a sulfo group, a phosphinoyl group or a phosphinoylamino group.

q represents an integer of from 0 to 5 and when q is 2 or greater, the $R^{55}$ groups may be the same or different. $R^{60}$ represents an alkyl group or an aryl group.

Specific examples of the compounds represented by formula (B-1) and (B-2) are set forth below, but the auxiliary developing agent for use in the present invention is by no means limited to these specific examples.

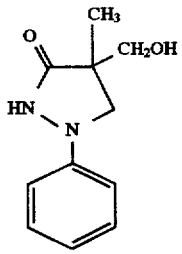

(ETA-1)

-continued

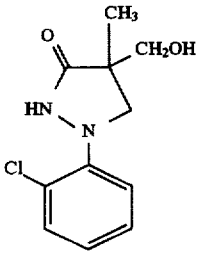

(ETA-2)

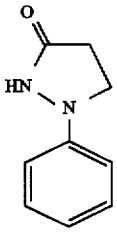

(ETA-3)

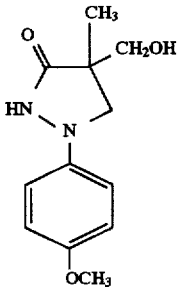

(ETA-4)

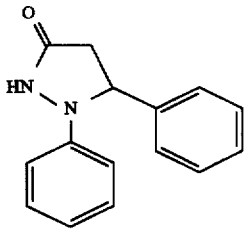

(ETA-5)

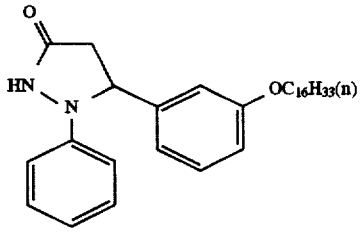

(ETA-6)

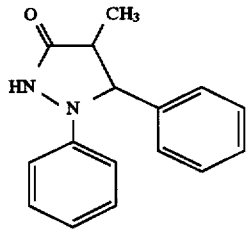

(ETA-7)

-continued

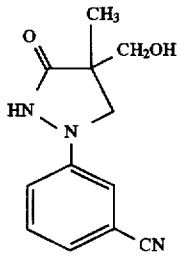

(ETA-8)

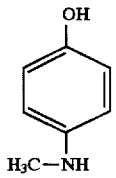

(ETA-9)

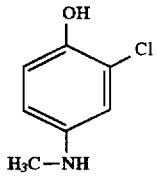

(ETA-10)

In the present invention, the layer to which the auxiliary developing agent is added is not particularly limited, however, the layer is preferably different from the layer containing the developing agent, more preferably a light-insensitive layer between the silver halide emulsion layer and the support.

In the present invention, a blocked photographic reagent which releases a photographically useful group upon the processing, represented by formula (A) may be used.

$$A—(L)_n—PUG \quad (A)$$

wherein A represents a block group of which bond to $(L)_n$—PUG is cleaved upon the development processing, L represents a linking group of which bond on the right side is cleaved after the bond of L on the left side in formula (A) is cleaved, n represents an integer of from 0 to 3, and PUG represents a photographically useful group.

The group represented by formula (A) is described below.

As the block group represented by A, any known block group may be used. Examples thereof include block groups such as an acyl group and a sulfonyl group as described in JP-B-48-9968, JP-A-52-8828, JP-A-57-82834, U.S. Pat. No. 3,311,476 and JP-B-47-44805 (corresponding to U.S. Pat. No. 3,615,617), block groups using an anti-Michael reaction as described in JP-B-55-17369 (corresponding to U.S. Pat. No. 3,888,677), JP-B-55-9696 (corresponding to U.S. Pat. No. 3,791,830), JP-B-55-34927 (corresponding to U.S. Pat. No. 4,009,029), JP-A-56-77842 (corresponding to U.S. Pat. No. 4,307,175), JP-A-59-105640, JP-A-59-105641 and JP-A-59-105642, block groups using the production of quinonemethide or a quinonemethide analogue by intramolecular electron transfer as described in JP-B-54-39727, U.S. Pat. Nos. 3,674,478, 3,932,480 and 3,993,661, JP-A-57-135944, JP-A-57-135945 (corresponding to U.S. Pat. No. 4,420,554), JP-A-57-136640, JP-A-61-196239, JP-A-61-196240 (corresponding to U.S. Pat. No. 4,702,999), JP-A-61-185743, JP-A-61-124941 (corresponding to U.S. Pat. No. 4,639,408) and JP-A-2-280140, block groups using intramolecular nucleophilic substitution reaction as described in U.S. Pat. Nos. 4,358,525, 4,330,617, JP-A-55-53330 (corresponding to U.S. Pat. No. 4,310,612), JP-A-59-121328, JP-A-59-218439 and JP-A-63-318555 (corresponding to European Unexamined Patent Publication 0295729), block groups using the ring cleavage of a 5- or 6-membered ring as described in JP-A-57-76541 (corresponding to U.S. Pat. No. 4,335,200), JP-A-57-135949 (corresponding to U.S. Pat. No. 4,350,752), JP-A-57-179842, JP-A-59-137945, JP-A-59-140445, JP-A-59-219741, JP-A-59-202459, JP-A-60-41034 (corresponding to U.S. Pat. No. 4,618,563) JP-A-62-59945 (corresponding to U.S. Pat. No. 4,888,268), JP-A-62-65039 (corresponding to U.S. Pat. No. 4,772,537), JP-A-62-80647, JP-A-3-236047 and JP-A-3-238445, block groups using the addition reaction of a nucleophilic agent to a conjugated unsaturated bond as described in JP-A-59-201057 (corresponding to U.S. Pat. No. 4,518,685), JP-A-61-95346 (corresponding to U.S. Pat. No. 4,690,885), JP-A-61-95347 (corresponding to U.S. Pat. No. 4,892,811), JP-A-64-7035, JP-A-64-42650 (corresponding to U.S. Pat. No. 5,066,573), JP-A-1-245255, JP-A-2-207249, JP-A-2-235055 (corresponding to U.S. Pat. No. 5,118,596) and JP-A-4-186344, block groups using the β-elimination reaction as described in JP-A-59-93442, JP-A-61-32839, JP-A-62-163051 and JP-B-5-37299, block groups using the nucleophilic substitution reaction of diarylmethanes as described in JP-A-61-188540, block groups using the Lossen rearrangement reaction as described in JP-A-62-187850, block groups using the reaction of an N-acyl form of thiazolidine-2-thione with an amine as described in JP-A-62-80646, JP-A-62-144163 and JP-A-62-147457, block groups having two electrophilic groups, which react with a nucleophilic agent having two nucleophilic groups as described in JP-A-2-296240 (corresponding to U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, JP-A-4-184338, International Unexamined Patent Publication 92/21064, JP-A-4-330438, International Unexamined Patent Publication 93/03419 and JP-A-5-45816, and those described in JP-A-3-236047 and JP-A-3-238445.

In formula (A), the group represented by L may be any as long as it is a linking group capable of cleaving $(L)_{n-1}$—PUG after being released from A upon the development processing. Examples thereof include a group using the cleavage of a hemiacetal ring as described in U.S. Pat. Nos. 4,146,396, 4,652,516 and 4,698,297, a timing group capable of causing an intramolecular nucleophilic substitution reaction as described in U.S. Pat. Nos. 4,248,962, 4,847,185 and 4,857,440, a timing group capable of causing a cleavage reaction using the electron transfer reaction as described in U.S. Pat. Nos. 4,409,323 and 4,421,845, a group capable of causing a cleavage reaction using the hydrolysis reaction of iminoketal as described in U.S. Pat. No. 4,546,073, a group capable of causing a cleavage reaction using the hydrolysis reaction of ester as described in West German Patent Application (OLS) No. 2,626,317, and a group capable of causing a cleavage reaction using the reaction with sulfite ion as described in European Patent 0572084.

PUG in formula (A) is described below.

PUG in formula (A) represents a photographically useful group such as an antifoggant and a photographic dye. In the present invention, the auxiliary developing agent represented by formula (B-1) or (B-2) is particularly preferably used as PUG.

When the auxiliary developing agent represented by formula (B-1) or (B-2) serves as the PUG in formula (A), the bonding site thereof is the oxygen atom or the nitrogen atom of the auxiliary developing agent.

The rapid processing used in the present invention is described in detail below.

The term "total processing time" as used in the present invention means the total of each processing time for development, fixing, water washing and drying.

The development of the present invention is characterized in that an image is formed by combining silver image and dye image upon the processing. In the development processing, a development step and a fixing step are essential but on the other hand, a bleaching step is inhibited. The development may also be performed using a method which produces no development waste, such as coating development. A coating fixing method free of either fixing or waste may also be used.

The developer for use in the present invention may contain an amino compound for accelerating the development. In particular, amino compounds described in JP-A-56-106244, JP-A-61-267759 and JP-A-2-208652 may be used. The content of the amino compound in the developer is preferably from 0.1 to 100 g/l.

The developer for use in the present invention has a pH of from 8.0 to 14.0, preferably from 8.3 to 12.5.

The alkali agent used for setting the pH of the developer for use in the present invention may be a usual water-soluble inorganic alkali metal salt (e.g., sodium hydroxide, sodium carbonate). The developer of the present invention may contain, in addition, a pH buffer such as sodium hydrogenphosphate, potassium hydrogenphosphate, sodium dihydrogenphosphate and potassium dihydrogenphosphate or a pH buffer described in JP-A-60-93433. The addition amount of the alkali agent or the pH buffer used for setting the pH value of the developer for use in the present invention is preferably 0.3 mol/l or more, more preferably from 0.4 to 1 mol/l.

The developer for use in the present invention may contain a compound described in JP-B-62-4702, JP-B-62-4703, JP-A-1-200249, JP-A-5-303179 and JP-A-5-53257 as a silver stain inhibitor.

In addition to the above-described additives such as an amino compound, an alkali agent and a silver stain inhibitor, the developer for use in the present invention may contain a development inhibitor such as potassium bromide and potassium iodide, an organic solvent such as dimethylformamido, methyl cellosolve, ethylene glycol, ethanol and methanol, and an antifoggant such as 5-methylbenzotriazole, 5-chlorobenzotriazole, 5-bromobenzotriazole, 5-butylbenzotriazole and benzotriazole.

Examples of the sulfite-base preservative for use in the developer for use in the present invention include sodium sulfite, potassium sulfite, lithium sulfite, ammonium sulfite, sodium bisulfite and potassium metabisulfite. The sulfite is preferably used in an amount of 0.01 mol/P or more, more preferably from 0.02 to 2.5 mol/l.

Further, those described in L. F. A. Maison, *Photographic Processing Chemistry*, The Focal Press (1966), pp. 226–229, U.S. Pat. Nos. 2,193,015 and 2,592,364 and JP-A-48-64933 may be used.

The developer may contain, if desired, a color toning agent, a surface active agent, a hard water softening agent and a hardening agent.

Examples of the chelating agent used in the developer include ethylenediaminediorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, transcyclohexanediaminet etraacetic acid, ethylenediaminetetraacetic acid, glycol ether diaminetetraacetic acid, ethylenediaminetetrakismethylenephosphonic acid, diethylenetriaminepentamethylenephosphonic acid, nitrilotrimethylenephosphonic acid, 1-hydroxyethylidene-l, 1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,4-disulfonic acid, sodium pyrophosphate, sodium tetrapolyphosphate and sodium hexametaphosphate. Among these, preferred are diethylenetriaminepentaacetic acid, triethylenetetraminehexaacetic acid, 1,3-diaminopropanoltetraacetic acid, glycol ether diaminetetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetrakismethylenephosphonic acid, diethylenetriaminepentaphosphonic acid, 1-hydroxy-propylidene-1,1-diphosphonic acid, 1-aminoethylidene-1,1-diphosphonic acid, 1-hydroxyethylidene-1,1-diphosphonic acid, and a salt thereof.

The developer for use in the present invention preferably contains potassium ions in a proportion of from 10 to 90 mol % and sodium ions in a proportion of from 10 to 90 mol %, more preferably potassium ions in a proportion of from 20 to 50 mol % and sodium ions in a proportion of from 50 to 80 mol %, of all cations.

The developer for use in the present invention may be formed into a concentrated solution to reduce the transportation cost or to save the storage space. In the case of a concentrated solution, the concentration degree is preferably 3 times or less, more preferably 2 times or less, so as to prevent the deposition of developer components at low temperatures. Also, components different in the solubility may be stored in several parts and they may be mixed and diluted at the time of use.

The developer for use in the present invention is most preferably in the form of a single-solution.

The replenishing amount of the developer in the present invention is, as a diluted developer, from 1 to 200 ml, preferably from 5 to 180 ml, more preferably from 10 to 150 ml, per $m^2$ of the light-sensitive material.

The development temperature and the development time in the development processing in the present invention is from 20° to 70° C. and from 5 to 60 seconds, respectively, preferably from 25° to 60° C. and from 5 to 45 seconds, respectively, more preferably from 32° to 38° C. and from 5 to 30 seconds, respectively.

The fixing solution for use in the present invention is described below.

The fixing solution for use in the present invention is an aqueous solution containing a thiosulfate as a fixing agent. Examples of the thios-lfate include sodium thiosulfate and ammonium thiosulfate. Among these, sodium thiosulfate is preferred in view of the environmental issue.

The use amount of the thiosulfate may be varied appropriately and it is generally from about 0.1 to about 5 mol/l.

The fixing solution may contain, if desired, a hardening agent (e.g., aluminum chloride, aluminum sulfate, water-soluble aluminum such as potassium alum), a preservative (e.g., sulfite, bisulfite), a pH buffer (e.g., acetic acid, boric acid), a pH adjusting agent (e.g., ammonia, sulfuric acid), a chelating agent, a surface active agent (e.g., anionic surface active agents such as sulfonated product, polyethylene-base surface active agents, amphoteric surface active agents described in JP-A-57-6804), a wetting agent (e.g., alkanolamine, alkylene glycol) or a fixing accelerator (e.g., thiourea derivatives described in JP-B-45-35754, JP-B-58-122535, JP-B-58-122536, alcohols having a triple bond within the molecule, thioehter compounds described in U.S.

Pat. No. 4,126,459, mesoionic compounds described in JP-A-4-143755, JP-A-4-143756, JP-A-4-143757, JP-A-4-170539).

In addition to the above-described compounds, the fixing agent may contain a tartaric acid, a citric acid, a gluconic acid, and a derivative thereof, either individually or in combination.

The pH of the fixing solution is 3 or more, preferably from 4.2 to 6.3.

The fixing temperature and the fixing time in the fixing processing is from 20° to 50° C. and from 5 seconds to 1 minute, respectively, more preferably from 25° to 40° C. and from 5 to 40 seconds, respectively.

The fixing solution may be formed into a concentrated solution to reduce the transportation cost or to save the storage space. In the case of a concentrated solution, the concentration degree is preferably 3 times or less, more preferably 2 times or less, so as to prevent the deposition of components of the fixing solution at low temperatures. Also, components different in the solubility may be stored in several parts and they may be mixed and diluted at the time of use.

The fixing solution of the present invention is most preferably in the form of a single-solution.

The replenishing amount of the fixing solution for use in the present invention is, as a diluted fixing solution, from 1 to 200 ml, preferably from 5 to 180 ml, more preferably from 10 to 150 ml, per $m^2$ of the light-sensitive material.

In the present invention, when the developer and the fixing solution are formed into a concentrated developer and a concentrated fixing solution, respectively, the solution in use is diluted and used as a replenisher or a mother solution. The dilution may be performed by adding a diluted developer and a diluted fixing solution which are previously diluted, to a developing tank and to a fixing tank, respectively, however, it is preferred to dilute the concentrated developer or the concentrated fixing solution with water into a use solution in each tank and feed the diluted solution as a replenisher (direct mixing dilution method).

When a chemical mixer is built in an automatic developing machine, the automatic developer preferably has a mechanism such that the developer cartridge and the fixing solution cartridge are used up simultaneously.

In the processing method for use in the present invention, the development and the fixing are followed by the processing with washing water and stabilizing solution and then by drying.

The washing water for use in the present invention is sometimes preferably subjected to removal of refuse or organic substances present in the water through a filter member or an active carbon filter as a previous processing before feeding the water into a water washing tank.

When the water washing is performed using a small amount of washing water, a squeeze roller washing tank described in JP-A-63-18350 is preferably disposed. Also, the construction of water washing described in JP-A-63-143548 is preferably used. Further, a part or whole of the overflow from the water washing or stabilization bath generated resulting from the replenishment of water treated with an antimold means to the water washing or stabilizing bath in accordance with the processing, may be used in the processing solution having a fixing ability which is a previous processing step, as described in JP-A-60-235133. As a method for reducing the replenishing amount of washing water, a multi-stage countercurrent system (for example, 2 stages, 3 stages) has been known from the old. According to the multi-stage countercurrent system, the light-sensitive material after fixing enters the processing in sequence in the clean direction and the water washing can be performed more efficiently. In the above-described water-saving processing or non-piped processing, an antimold means is preferably applied to the washing water or the stabilizing solution.

Known examples of the antimold means include an ultraviolet ray irradiation method described in JP-A-60-263939, a method of using a magnetic field described in JP-A-60-263940, a method of converting water into pure water using an ion exchange resin described in JP-A-61-131632, a method of circulating water in a filter and an adsorbent column while blowing ozone thereinto described in JP-A-4-151143, a method using microbiodegradation described in JP-A-4-240636 and a method of using an antiseptic described in JP-A-62-115154, JP-A-62-153952, JP-A-62-220951 and JP-A-62-209532, and these methods may be used in combination.

Further, antiseptics, antimolds or surface active agents described in M. W. Beach, *SMPTE Journal, "Microbiological Growths in Motion-picture Processing"*, Vol. 85 (1976), R. O. Deegan, J. Imaging Tech., "Photo. Processing Wash Water Biocides", Vol. 10, No. 6 (1984), JP-A-57-8542, JP-A-57-58143, JP-A-58-105145, JP-A-57-132146, JP-A-58-18631, JP-A-57-97530 and JP-A-57-257244 may be used, if desired, in combination.

Furthermore, in the water washing bath (or stabilization bath), isothiazoline-base compounds and bromochlorodimethylhydantoin described in R. T. Kreiman, *J. Image Tech.*, Vol. 10, No. 6, Item 242 (1984), isothiazoline-base compounds described in *Research Disclosure*, Vol. 205, No. 20526 (May, 1981) and *Research Disclosure*, Vol. 228, No. 22845 (April, 1983), and the compounds described in JP-A-62-209532 may be used, if desired, as an antiseptic in combination.

In addition, the compounds described in Hiroshi Horiguchi, *Bokin Bobai no Kagaku*, Sankyo Shuppan (1982) and *Bokin Bobai Giiutsu Handbook*, Nippon Bokin Bobai Gakkai, Hakuhodo (1986) may also be contained.

The automatic developing machine which can be used in the present invention preferably has a means for preventing lime deposit in the water washing tank such as an electromagnetic valve disposed at the exhaust port of the water washing tank.

The light-sensitive material processed in the development, fixing and water washing (or stabilization) passes through squeeze rollers for squeezing washing water and then is dried. The drying is performed at a temperature of from about 40° to about 100° C. The drying time may be appropriately varied depending upon the ambient state, however, it is usually from about 5 seconds to 3 minutes. The drying is preferably performed at a temperature of from 40° to 80° C. for from about 5 seconds to 2 minutes.

As the automatic developing machine for use in the present invention, various types of automatic developing machine, such as roller conveyance type and belt conveyance type, may be used, however, an automatic developing machine of roller conveyance type is preferred. Further, an automatic developing machine comprising a developing tank having a small open ratio as described in JP-A-1-193853 is preferred and the open ratio is preferably 0.04 or less, more preferably 0.03 or less, most preferably 0.025 or less. By using an automatic developing machine comprising such a developing tank, air oxidation of the developing agent or evaporation of water can be suppressed and the replenishing amount can be reduced. In the processing environment, the drying is performed after squeezing washing water, namely, passing the light-sensitive material through squeeze rollers.

When the processing is performed according to the light-sensitive processing system for use in the present invention where the Dry to Dry time is 90 seconds or less, it is preferred, for preventing non-uniform development peculiar to rapid processing, to use a rubber material roller described in JP-A-63-151943 as the roller at the outlet of the development processing tank, to set the discharge flow velocity for stirring of the developer within the development processing tank to 10 m/min or more as described in JP-A-63-151944, or to intensify the stirring during the development processing more than in the stand-by time as described in JP-A-63-264758. When a further rapid processing is performed, the rollers in the fixing tank preferably have an opposed roller constitution so as to increase the fixing rate. By using the opposed roller constitution, the number of rollers can be reduced and the processing tank can be down-sized. Namely, the automatic developing machine can be made more compact.

In the present invention, a flexible replenisher container capable of removable disposition in the developing machine having an oxygen permeability of 50 ml/m$^2$·atm·day or less (at a temperature of 20° C. and a relative humidity of 60%) is preferably used.

Examples of the flexible and easily handleable material having an oxygen permeability of 50 ml/m$^2$·atm·day or less (at a temperature of 20° C. and a relative humidity of 60%) include cellophane, polyethylene, polyester, polyvinyl chloride, polyvinylidene chloride, polypropylene, nylon, aluminum foil-laminated film, a film deposited with a metal such as aluminum and a silica-deposited film. In view of easy processability into the shape of the container and sufficient strength when formed into the shape of the container, plastic materials containing at least one of an ethylene-vinyl acetate copolymer saponification product and a nylon and having an oxygen permeability of 50 ml/m$^2$·atm·day or less (at a temperature of 20° C. and a relative humidity of 60%), preferably 25 ml/m$^2$·atm·day or less (at a temperature of 20° C. and a relative humidity of 60%) are preferred.

By storing the developer in the above-described plastic material-made container, stable photographic performances of the developer can be attained during a long-term storage.

The replenisher container comprising plastic materials containing at least one of an ethylene-vinyl acetate copolymer saponification product and a nylon and having an oxygen permeability of 50 ml/m$^2$·atm·day or less (at a temperature of 20° C. and a relative humidity of 60%) may be formed of the plastic material alone or may be formed of a composite film obtained by laminating a film comprising a plurality of materials to a substrate.

The shape of the replenisher container formed of these plastic materials may be of cubic type or of lamination pillow type, however, from the standpoint that the volume of the replenisher container deformed after feeding of the replenisher can be almost nil, a pillow type container may be used.

The photographic light-sensitive material of the present invention can be preferably used in X-ray photographing using the following fluorescent substances as a fluorescent intensifying screen.

Blue Fluorescent Substance:

$Y_2O_2S$:Tb, LaOBr:Tb, BaFCl:Eu

Green Fluorescent Substance:

$Gd_2O_2S$:Tb:$LaO_2S$:Tb

UV Fluorescent Substance:

titanium-free hafnium zirconium gelamanate phosphors described in JP-A-6-11804, $YTaO_4$, $YTaO_4$:Nb, $YTaO_4$:Gd The UV fluorescent substance of the present invention has an emission wavelength of preferably 400 nm or less, more preferably 370 nm or less.

Representative examples of the fluorescent substance include M' phase $YTaO_4$ alone and compounds obtained by adding thereto Gd, Bi, Pb, Ce, Sr, Al, Rb, Ca, Cr, Cd or Nb; compounds obtained by adding Gd, Tm, Gd and Tm, Gd and Ce, or Tb to LaOBr; oxides of HfZr alone and compounds obtained by adding thereto Ge or Ti alkali metal; $Y_2O_3$ alone and compounds added thereto Gd and Eu; compounds obtained by adding Gd to Y202S: and compounds using Gd, Tl and Ce as activating agents to the mother body of various fluorescent substances. Among these, preferred are M' phase $YTaO_4$ alone and compounds obtained by adding thereto Gd or Sr; compounds obtained by adding Gd, Tm, or Gd and Tm to LaOBr; and oxides of HfZr and compounds obtained by adding thereto Ge or Ti alkali metal.

The particle size of the fluorescent substance is preferably from 1 to 20 μm but it may be varied according to the sensitivity required or in view of the matter of production. The coating amount is preferably from 400 to 2,000 g/mm$^2$, however, it may vary depending upon the sensitivity or image quality required and cannot be concluded discriminately. Further, a particle size distribution may be present from the vicinity of the support towards the surface on one intensifying screen. In this case, particles on the surface are generally larger. The space filling rate of fluorescent substances is generally 40% or more, preferably 60% or more.

When photographing is performed by disposing fluorescent substance layers on both sides of the light-sensitive material, the coating amount of the fluorescent substance can be varied between the X-ray entering side and the side opposite thereto. In general, because of shielding by the intensifying screen on the X-ray entering side, when a high-sensitive system is required, the coating amount of the intensifying screen on the X-ray entering side is made smaller.

Examples of the support for use in the present invention include paper, metal sheet and polymer sheet, however, a flexible sheet such as polyethylene terephthalate is usually used. If desired, a reflecting agent or a light absorbent may be added to the support or may be provided as a separate layer on the surface of the support. Further, if desired, fine irregularities may be provided on the support surface or an adhesion layer for intensifying the firm adhesion to the fluorescent layer or an electrically conductive layer may be provided as an undercoat layer. Examples of the reflecting agent include zinc oxide, titanium oxide and barium sulfate, however, titanium oxide and barium sulfate are preferred because the emission wavelength of the fluorescent substance is short. The reflecting agent may be present not only between the support and the fluorescent substance layer but also in the fluorescent substance layer. When the reflecting agent is incorporated into the fluorescent substance layer, it is preferred that the reflecting agent is present throughout the vicinity of the support.

Examples of the binder of the intensifying screen for use in the present invention include natural polymer substances such as proteins (e.g., gelatin), polysaccharides (e.g., dextran, cornstarch) and gum arabic; synthetic polymer materials such as polyvinyl butyral, polyvinyl acetate, polyurethane, polyalkylacrylate, vinylidene chloride, nitrocellulose, fluorine-containing polymer and polyester; and a mixture and a copolymer of these. A preferred binder has, as a fundamental performance, high transmissivity of the emission from the fluorescent substance. In this point of view, gelatin, cornstarch, acrylic polymers, fluorine-containing olefin polymers, polymers containing a fluorine-containing olefin as a copolymer component and styrene/acrylonitrile copolymers may be used. The above-described binder may have a functional group capable of being crosslinked by a crosslinking agent. Further, depending upon the image quality performance required, an absorbent of the emission from the fluorescent substance may be added to the binder or a binder having a low transmissivity may be used. Examples of the absorbent include a pigment, a dye and an ultraviolet absorbing compound. The ratio of the fluorescent substance to the binder is, in general, in terms of volume ratio, from 1:5 to 50:1, preferably from 1:1 to 15:1. The ratio of the fluorescent substance to the binder may be uniform or non-uniform in the thickness direction.

The fluorescent substance layer is usually formed by a coating method using a coating solution obtained by dispersing the fluorescent substance in a binder solution. Examples of the solvent of the coating solution include water, organic solvents such as alcohol, chlorine-containing hydrocarbon, ketone, ester and ether aromatic compounds, and a mixture thereof.

In addition to the fluorescent substances, the coating solution may contain a dispersion stabilizer such as phthalic acid, stearic acid, caproic acid and surface active agents, and a plasticizer such as phosphoric ester, phthalic ester, glycolic ester, polyester and polyethylene glycol.

The thickness of the fluorescent substance layer is generally from 30 to 300 μm.

In the present invention, a protective layer may be provided on the fluorescent substance layer. The protective layer is usually provided by a method of coating it on the fluorescent layer or a method of separately preparing a protective layer film and laminating it onto the fluorescent substance layer. When the protective layer is coated, it may be coated simultaneously with the fluorescent substance layer or after coating and drying the fluorescent substance layer. The protective layer may comprise a material the same as or different from the binder of the fluorescent substance layer. Examples of the material for use in the protective layer include, in addition to the materials described above for the binder of the fluorescent substance layer, cellulose derivatives, polyvinyl chloride, melamine, phenol resins and epoxy resins. Preferred are gelatin, cornstarch, acrylic polymers, fluorine-containing olefin polymers, polymers containing a fluorine-containing olefin as a copolymer component and styrene/acrylonitrile copolymers. The thickness of the protective layer is generally from 1 to 20 μm, preferably from 2 to 10 μm, more preferably from 2 to 6 μm. The surface of the protective layer of the present invention is preferably subjected to embossing. Further, the protective layer may contain a matting agent or a material having a light scattering property to the emission according to the image required, for example, titanium oxide.

The protective layer of the fluorescent substance of the present invention may contain a slipping agent to impart a slipping property to the surface thereof. Preferred examples of the slipping agent include a polysiloxane skeleton-containing oligomer and a perfluoroalkyl group-containing oligomer.

The protective layer of the present invention may contain an electrical conductivity-imparting agent. Examples of the electrical conductivity-imparting agent include white or transparent inorganic electrically conductive substances or organic antistatic agents. Preferred examples of the inorganic electrically conductive substance include ZnO powder, whiskers, $SnO_2$ and ITO.

The light-sensitive material according to the present invention exerts effects in particular when at least one silver halide emulsion layer is provided on each side of the support.

When the present invention is applied to the light-sensitive material having on each side thereof an emulsion, in addition to the above-described effects, a high-quality and highly sharp image can be obtained. Furthermore, an unexpected effect can be obtained such that when the replenishing amount of the processing solutions in the development processing is reduced, the tanks or the rollers are not contaminated.

In the chemical sensitization, gold sensitization using a gold compound, sensitization using a metal such as iridium, platinum, rhodium or palladium, sulfur sensitization using a sulfur-containing compound, reduction sensitization using a tin salt or polyamine, sensitization using a selenium compound or sensitization using a tellurium compound may be used individually or in combination. The tabular silver halide grain can be prepared by appropriately combining the methods known in the art.

The silver amount in the light-sensitive material of the present invention is preferably from 0.5 to 5 $g/m^2$ (per one surface), more preferably from 0.7 to 3.4 $g/m^2$ (per one surface).

In view of adaptability for rapid processing, the silver amount preferably does not exceed 5 $g/m^2$.

With respect to various additives for use in the light-sensitive material of the present invention, there is no particular limitation and for example, those described in the following portions of JP-A-2-68539 (corresponding to U.S. Pat. No. 5,118,600) may be used.

| Items | Pertinent Portion |
|---|---|
| 1. Silver halide emulsion and preparation method thereof | JP-A-2-68539, from page 8, right lower column, line 6 from the bottom to page 10, right upper column, line 12 |
| 2. Chemical sensitization | ibid., page 10, from right upper column, line 13 to left lower column, line 16 |
| 3. Antifoggant, stabilizer | ibid., from page 10, left lower column, line 17 to page 11, left upper column, line 7 and from page 3, left lower column, line 2 to page 4, left lower column |
| 4. Spectral sensitizing dye | ibid., from page 4, right lower column, line 4 to page 8, right lower column |
| 5. Surface active agent, antistatic agent | ibid., from page 11, left upper column, line 14 to page 12, left upper column, line 9 |
| 6. Matting agent, slipping agent, plasticizer | ibid., page 12, from left upper column, line 10 to right upper column, line 10 and page 14, from left lower column line 10 to right lower column, line 1 |
| 7. Hydrophilic colloid | ibid., page 12, from right upper column, line 11 to left lower column, line 16 |
| 8. Hardening agent | ibid., from page 12, left lower column, line 17 to page 13, right upper column, line 6 |
| 9. Support | ibid., page 13, right upper column, lines 7 to 20 |
| 10. Dye, mordant | ibid., from page 13, left lower column, line 1 to page 14, left lower column, line 9 |

In the photographic light-sensitive material of the present invention, the image is preferably formed using a silver image and a dye image in combination. The dye image preferably has a substantially black color. The density sharing ratio therebetween may be freely changed, however, in an X-ray image formation system, the density sharing ratio of silver image to dye image is preferably from 1:10 to 10:1, more preferably from 3:7 to 7:3.

The total processing time of the photographic light-sensitive material of the present invention in an automatic developing machine is preferably 90 seconds or less, more preferably 60 seconds or less.

The photographic material of the present invention is preferably used for forming a X-ray image for medical, preferably a black and white image.

When a medical X-ray image is formed in a combination system of a fluorescent substance screen and a photographic light-sensitive material, the sharpness of the image is one of important factors for elevating the diagnostic performance. On the other hand, in the present invention, a silver image and a dye are used in combination and along the expansion of a dye cloud, the sharpness of the image readily lowers. In order to overcome this problem, it is important to improve the sharpness of the image by other methods. The present inventors have made extensive investigations and found that an image small in the reduction in sensitivity and having excellent sharpness can be formed by reducing the crossover light to 20% or less rather than by using a development inhibitor-releasing coupler commonly used in light-sensitive materials. The crossover light is more preferably 15% or less, still more preferably 10% or less.

The crossover light may be reduced by a method of using a solid dispersion dye as described in JP-A-1-172828, a technique of mordanting a crossover light absorbing dye to a film undercoat layer and a method of increasing the crossover light absorptivity of the silver halide emulsion using a spectral sensitizing dye as described in JP-A-1-126645, or a method of adsorbing a dye to a fine grain emulsion or a fine grain tabular emulsion having substantially no light sensitivity and coating the emulsion as an undercoat layer of an emulsion layer.

The present invention will be described in greater detail with reference to the following Examples, but the invention should not be construed as being limited thereto.

EXAMPLE 1

Preparation of (100) Face Tabular Emulsion A

Into a reaction vessel, 1,582 ml of an aqueous gelatin solution (containing 19.5 g of Gelatin-1 (deionized alkali-processed ossein gelatin having a methionine content of about 40 μmol/g) and 7.8 ml of 1N solution of $HNO_3$, and having a pH of 4.3) and 13 ml of Solution NaCl-1 (containing 10 g of NaCl in 100 ml) were poured and while keeping the temperature at 40° C., Solution Ag-1 (containing 20 g of $AgNO_3$ in 100 ml) and Solution X-1 (containing 7.05 of NaCl in 100 ml) were added simultaneously each in an amount of 15.6 ml at a rate of 62.4 ml/min. After stirring for 3 minutes, Solution Ag-2 (containing 2 g of $AgNO_3$ in 100 ml) and Solution X-2 (containing 1.4 g of KBr in 100 ml) were added simultaneously each in an amount of 28.2 ml at a rate of 80.6 ml/min. After stirring for 3 minutes, Solution Ag-1 and Solution X-1 were added simultaneously each in an amount of 46.8 ml at a rate of 62.4 ml/min. After stirring for 2 minutes, 203 ml of an aqueous gelatin solution (containing 13 g of Gelatin-1, 1.3 g of NaCl and 1N solution of NaOH to adjust the pH as shown in Table 1) was added to give a pCl of 1.8, the temperature was raised to 75° C., the pCl was adjusted to 1.8 and then ripening was performed for 42 minutes. An AgCl fine grain emulsion (average grain diameter: 0.1 μm) was added at a rate, in terms of the addition rate of AgCl, of $2.68\times10^{-2}$ mol/min over 20 minutes. Thereafter, the emulsion was ripened for 10 minutes, a precipitant was added, the temperature was lowered to 35° C. and then the emulsion was washed by precipitation. An aqueous gelatin solution was added and the pH was adjusted at 60° C. to 6.0. A transmission-type electron microphotographic image (hereinafter referred to as TEM) of a replica of the grain was observed. The resulting emulsion was a high silver chloride (100) face tabular grain containing 0.44 mol % of AgBr on a silver basis. The shape and characteristic values of the grain are as follows:

(entire projected area of tabular grains having an aspect ratio of 2 or more/sum of projected areas of all AgX grains)×100 $=a_1=90\%$;

(average aspect ratio (average diameter/average thickness) of tabular grains)$=a_2=9.3$;

(average diameter of tabular grains)$=a_3=1.67$ μm; and (average thickness)$=a_4=0.18$ μm.

Preparation of (111) Face Tabular Emulsion B

Silver chloride tabular grains were prepared as follows.

| | | |
|---|---|---|
| Solution (1): | Inactive gelatin | 30 g |
| | Crystal habit controlling agent A | 0.8 g |
| | 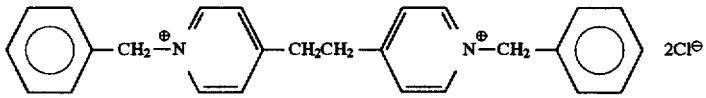 | |
| | NaCl | 4 g |
| | $H_2O$ | 1,750 ml |
| Solution (2): | $AgNO_3$ | 7.6 g |
| | $H_2O$ to make | 30 ml |
| Solution (3): | NaCl | 2.8 g |
| | $H_2O$ to make | 30 ml |
| Solution (4): | $AgNO_3$ | 24.5 g |
| | $H_2O$ to make | 96 ml |
| Solution (5): | NaCl | 0.3 g |
| | $H_2O$ to make | 65 ml |
| Solution (6): | $AgNO_3$ | 101.9 g |
| | $H_2O$ to make | 400 ml |
| Solution (7): | NaCl | 37.6 g |
| | $H_2O$ to make | 400 ml |

To Solution (1) kept at 35° C., Solution (2) and Solution (3) were added simultaneously while stirring over 1 minute and the temperature of the solution was elevated to 50° C. over 15 minutes. At this time, grains corresponding to about 5.7% of all silver amount were formed. Then, Solution (4) and Solution (5) were added simultaneously over 24 minutes and further, Solution (6) and Solution (7) were simultaneously added over 40 minutes to obtain a silver chloride tabular emulsion.

The emulsion was washed with water and desalted by precipitation, 30 g of gelatin and $H_2O$ were added thereto, 2.0 g of phenoxyethanol and 0.8 g of sodium polystyrenesulfonate as a thickener were added, and the emulsion was redispersed by caustic soda to have a pH of 6.0.

The thus-obtained emulsion was a silver chloride tabular emulsion comprising main planes of (111) face having $a_1$=90%, $a_3$=1.55 μm, $a_4$=0.18 μm, $a_2$=8.6 and a coefficient of variation of the circle-corresponding projected area diameter of 19%.

Preparation of Tabular Grain C

Into a container kept at 55° C. and containing 1 l of water having added thereto 6.0 g of potassium bromide and 7.0 g of a low molecular weight gelatin having an average molecular weight of 15,000, 37 ml of aqueous silver nitrate solution (silver nitrate: 4.00 g) and 38 ml of an aqueous solution containing 5.9 g of potassium bromide were added while stirring by a double jet method over 37 seconds. Then, 18.6 g of gelatin was added, the temperature was raised to 70° C. and 89 ml of an aqueous silver nitrate solution (silver nitrate: 9.80 g) was added over 22 minutes. Here, 7 ml of a 25% aqueous ammonia solution was added, the emulsion was physically ripened for 10 minutes while keeping the temperature and then 6.5 ml of a 100% acetic acid solution was added. Subsequently, an aqueous solution of 153 g of silver nitrate and an aqueous solution of potassium bromide were added while keeping the pAg at 8.5 by a controlled double jet method over 35 minutes. Then, 15 ml of 2N of potassium thiocyanate solution was added. After effecting physical ripening at the same temperature for 5 minutes, the temperature was lowered to 35° C. As a result, monodisperse pure silver bromide tabular grains having $a_1$=95%, $a_3$ (average projected area diameter)=1.50 μm, $a_4$ (thickness)=0.185 μm, $a_2$ (average aspect ratio)=8.1 and a coefficient of variation of the diameter of 18.5%.

Thereafter, soluble salts were removed by a precipitation method. The temperature was again raised to 40° C., then, 30 g of gelatin, 2.35 g of phenoxyethanol and 0.8 g of sodium polystyrenesulfonate as a thickener were added and the pH and the pAg were adjusted to 5.90 and 8.00, respectively, with caustic soda and silver nitrate solution.

Preparation of Tabular Grains D and E

Silver Chlorobromide Tabular Emulsions D and E comprising main planes of (111) face, having almost the same grain shape such as the aspect ratio and the grain size, and having a silver chloride content of 17% and 24%, respectively, each was prepared under the same conditions as in the preparation of Tabular Grain C except that in the growth stage conducted by a controlled double jet method while keeping the pAg of 8.5, a mixed solution of potassium bromide and potassium chloride was used in place of potassium bromide solution.

Preparation of Silver Halide Emulsion F

Into a container kept at 53° C. and containing 1 l of water having dissolved therein 32 g of gelatin, 0.3 g of potassium bromide, 5 g of sodium bromide and 46 mg of Compound [I]:

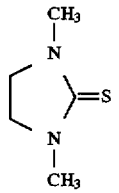

were placed, then, 444 ml of an aqueous solution containing 80 g of silver nitrate and 452 ml of an aqueous solution containing 45 g of potassium bromide and 5.5 g of sodium chloride were added by a double jet method over about 20 minutes, and thereafter, 400 ml of an aqueous solution containing 80 g of silver nitrate and 415 ml of an aqueous solution containing 46.4 g of potassium bromide, 5.7 g of sodium chloride and potassium hexachloroiridate (III) ($10^{-7}$ mol/mol-Ag) were added by a double jet method over about 25 minutes to obtain a cubic monodisperse silver chlorobromide emulsion (coefficient of variation of the projected area diameter: 10%) having an average grain size (projected area diameter) of 0.34 μm.

The resulting emulsion was subjected to desalting by a coagulation method and then the pH and the pAg were adjusted to 6.5 and 8.5, respectively, by adding 62 g of gelatin and 1.75 g of phenoxyethanol.

Chemical Sensitization

Grains A to F prepared as described above each was subjected to chemical sensitization while stirring and keeping the temperature at 60° C. First, $10^{-4}$ mol of Thiosulfonic Acid Compound-I was added per mol of silver halide. Then, 1.0 mol %, based on the total silver amount, of AgBr fine grains having a diameter of 0.10 μm was added and further, $1\times10^6$ mol/mol-Ag of thiourea dioxide was added. While keeping the state for 22 minutes, reduction sensitization was effected. Thereafter, $3\times10^4$ mol/mol-Ag of 4-hydroxy-6-methyl-1,3,3a,7-tetraazaindene, Sensitizing Dye-1 and Sensitizing Dye-2 were added. Further, calcium chloride was added. Subsequently, sodium sulfate ($6\times10^6$ mol/mol-Ag) and Selenium Compound-I ($4\times^6$ mol/mol-Ag) were added. Furthermore, $1\times10^5$ mol/mol-Ag and $3.0\times10^{-3}$ mol/mol-Ag of potassium thiocyanate were added and after 40 minutes, each emulsion was cooled to 35° C.

Thus, the preparation (chemical ripening) of emulsions was completed.

Thiosulfonic Acid Compound-I
$C_2H_5SO_2SNa$

Sensitizing Dye-1

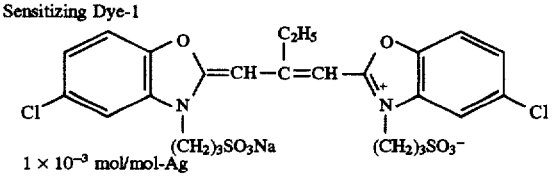

$1\times10^{-3}$ mol/mol-Ag

-continued

Sensitizing Dye-2

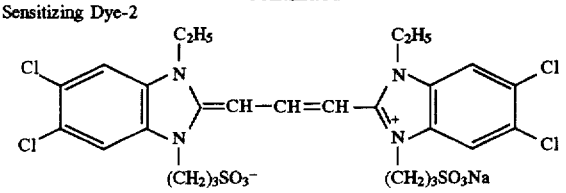

$1 \times 10^{-5}$ mol/mol-Ag

Selenium Compound-I

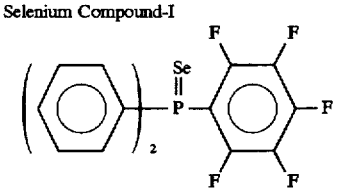

(Preparation of Coating Solution for Auxiliary Developing Agent Coated Layer)

An coating solution for an auxiliary developing agent was prepared so as to contain Auxiliary Developing Agent ETA-1 (methanol solution) and Auxiliary Developing Agent ETA-5 (solid fine grain dispersion) in an amount of $1\times10^{-2}$ mol per mol of silver halide, and so as to give a gelatin coverage of 0.5 g/m$^2$.

(Preparation of Coating Solution for Emulsion Coated Layer)

An emulsion coating solution was prepared by adding following chemicals to each of emulsions subjected to chemical sensitization. The addition amount of chemicals is per mol of silver halide.

| | |
|---|---|
| Gelatin (including gelatin in emulsion) | 111 g |
| Dextran (average molecular weight: 39,000) | 21.5 g |
| Sodium polyacrylate (average molecular weight: 400,000) | 5.1 g |
| Sodium polystyrenesulfonate (average molecular weight: 600,000) | 1.2 g |
| Hardener: The addition amount was controlled to give a 1,2-bis (vinylsulfonylacetamido)ethane swelling ratio of 230%. | |
| Compound-I | 42.1 mg |
| Compound-II | 10.3 g |
| Compound-III | 0.11 g |
| Compound-IV | 8.5 mg |
| Compound-V | 0.43 g |
| Compound-VI | 0.004 g |
| Compound-VII | 0.1 g |
| Compound-VIII | 0.1 g |

The pH of the coating solution was adjusted with NaOH to 6.1. Further, an emulsified product containing a coupler for color formation and a reducing agent for color formation as shown in Table 1 below was added thereto as shown in Tables 2 and 3.

Compound-I

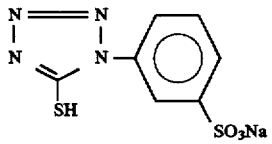

-continued

Compound-II

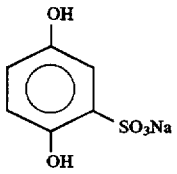

Compound-III

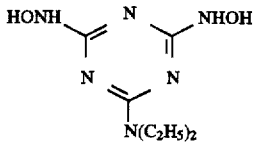

Compound-IV

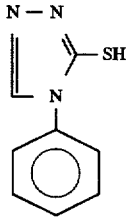

Compound-V

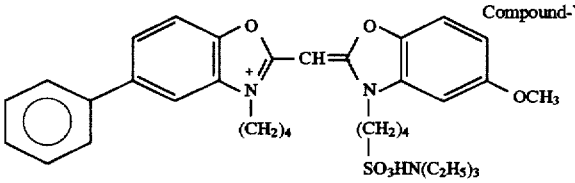

Compound-VI

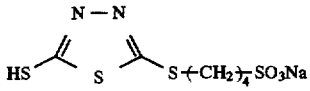

Compound-VII

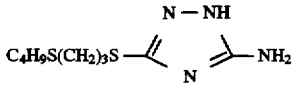

Compound-VIII

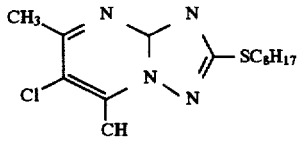

To the coating solution prepared above, Dye Emulsified Product S described below was added so that each of Ultraviolet Absorbing Dyes-I to III could be coated in an amount of 5 mg/m$^2$ per one surface, to prepare emulsion coating solutions.

Dye-I

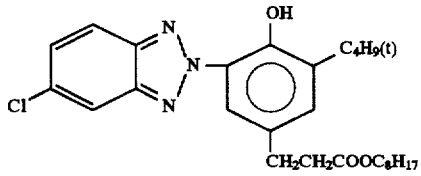

Dye-II

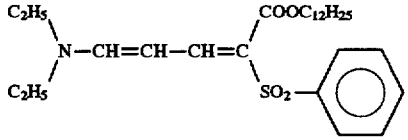

-continued

Dye-III

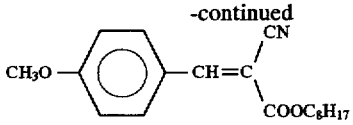

(Preparation of Dye Emulsified Product S)

The above-described Dye-i, Dye-II and Dye-III each in an amount of 20 g, 62.8 g of High Boiling Point Organic Solvent-I shown below, 62.8 g of High Boiling Point Organic Solvent-II shown below and 333 g of ethyl acetate were dissolved at 60° C. Then, 65 ml of a 5% aqueous solution of sodium dodecylsulfonate, 94 g of gelatin and 581 ml of water were added and emulsion-dispersed by a dissolver at 60° C. for 30 minutes. Thereafter, 2 g of Compound-VI shown below and 6 l of water were added and the temperature was lowered to 40° C. The resulting solution was concentrated until the total amount was reduced to 2 kg using Ultrafiltration Labo Module ACP1050 manufactured by Asahi Chemical Industry Co., Ltd. and thereto, 1 g of Compound-VI was added to obtain Dye Emulsified Product S.

High Boiling Point Organic Solvent-1

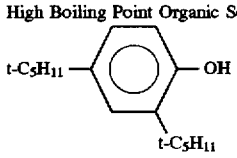

High Boiling Point Organic Solvent-II

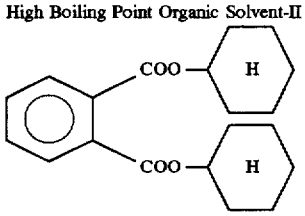

Compound-VI

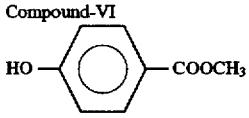

A coupler for color formation and a reducing agent for color formation were dissolved in 73 ml of ethyl acetate and 52 g of Solv-1 as shown in Table 1 and the resulting solutions each was emulsion-dispersed in 420 ml of a 12% aqueous gelatin solution containing a 10% sodium dodecylbenzenesulfonate and citric acid to obtain emulsified products as shown in Table 1.

TABLE 1

Solv-1

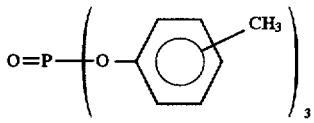

| Emulsified Product | Coupler for Color Formation | | Reducing Agent for Color Formation |
|---|---|---|---|
| A' | (C-1) | $3.5 \times 10^{-3}$ mol | (1) $1.0 \times 10^{-1}$ mol |
| | (C-8) | $3.5 \times 10^{-3}$ mol | |
| | (C-11) | $3.5 \times 10^{-3}$ mol | |
| B' | (C-4) | $3.5 \times 10^{-3}$ mol | (9) $1.0 \times 10^{-1}$ mol |
| | (C-14) | $3.5 \times 10^{-3}$ mol | |

TABLE 1-continued

Solv-1

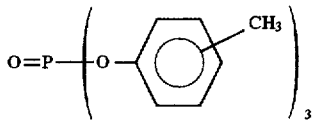

| | | | |
|---|---|---|---|
| | (C-13) | $3.5 \times 10^{-3}$ mol | |
| C' | (C-2) | $3.5 \times 10^{-3}$ mol | (11) $1.0 \times 10^{-1}$ mol |
| | (C-16) | $3.5 \times 10^{-3}$ mol | |
| | (C-12) | $3.5 \times 10^{-3}$ mol | |
| D' | (C-7) | $3.5 \times 10^{-3}$ mol | (22) $1.0 \times 10^{-1}$ mol |
| | (C-11) | $3.5 \times 10^{-3}$ mol | |
| | (C-19) | $3.5 \times 10^{-3}$ mol | |

(Preparation of Coating Solution for Surface Protective Layer)

The coating solution for the surface protective layer was prepared to give a coating amount of each component as described below.

| | |
|---|---|
| Gelatin | 0.780 g/m² |
| Sodium polyacrylate (average molecular weight: 400,000) | 0.035 g/m² |
| Sodium polystyrenesulfonate (average molecular weight: 600,000) | 0.0012 g/m² |
| Polymethyl methacrylate (average particle size: 3.7 μm) | 0.072 g/m² |
| Coating Aid-I | 0.020 g/m² |
| Coating Aid-II | 0.037 g/m² |
| Coating Aid-III | 0.0080 g/m² |
| Coating Aid-IV | 0.0032 g/m² |
| Coating Aid-V | 0.0025 g/m² |
| Compound-VII | 0.0022 g/m² |
| Proxel | 0.0010 g/m² |
| pH adjusted with NaOH | 6.8 |

Coating Aid-I

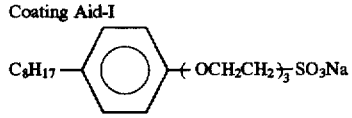

Coating Aid-II $C_{18}H_{33}O(CH_2CH_2O)_{10}H$

Coating Aid-III $C_{17}H_{33}CON(CH_3)CH_2CH_2SO_3Na$

Coating Aid-IV $C_8F_{17}SO_2N(C_3H_7)(CH_2CH_2O)_{15}H$

Coating Aid-V $C_8F_{17}SO_2N(C_3H_7)(CH_2CH_2O)_4(CH_2)_4SO_3Na$

Coating Aid-VII

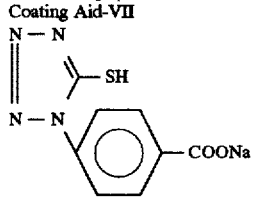

(Preparation of Support)

(1) Preparation of Dye Dispersion B for Undercoat Layer

The following Dye-II was subjected to ball mill treatment according to the method described in JP-A-63-197943.

Dye-II:

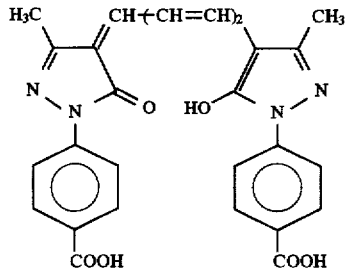

To 2 l-volume ball mill, 434 ml of water and 791 ml of a 6.7% aqueous solution of a surface active agent Triton X200 (trademark) (TX-2000 (trademark)) were placed. To the resulting solution, 20 g of the dye was added. Then, 400 ml of zirconium oxide ($ZrO_2$) beads (size: 2 mm in diameter) were added and the content was crushed for 4 days. Thereafter, 160 g of a 12.5% gelatin was added. After defoaming, $ZrO_2$ beads were removed by filtration. When the resulting dye dispersion was observed, the crushed dye had a wide particle size distribution of from 0.05 to 1.15 μm and the average particle size was 0.37 μm.

Dye particles having a size of 0.9 μm or more were removed by centrifugal separation.

Thus, Dye Dispersion B was obtained.

(2) Preparation of Support

A biaxially stretched polyethylene terephthalate film having a thickness of 175 μm was subjected to treatment with corona discharge and thereon, the first undercoating solution having the following composition was coated by a wire convertor to give a coating amount of 4.9 ml/m² and dried at 185° C. for 1 minute.

On the opposite surface, the first undercoat layer was provided in the same manner. The polyethylene terephthalate contained 0.06 wt % of Dye-IV and 0.06 wt % of Dye-V.

Dye-IV

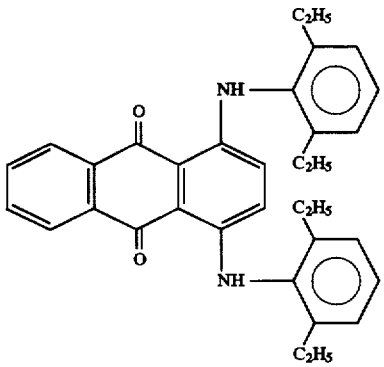

-continued

Dye-V

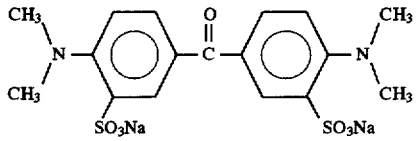

| | |
|---|---|
| Butadiene-styrene copolymer latex solution (butadiene having solid content of 40%/styrene = 31/69 by weight) | 158 ml |
| 2,4-Dichloro-6-hydroxy-s-triazine sodium salt 4% solution | 41 ml |
| Distilled water | 801 ml |

*The latex solution contained 0.4 wt % of the following compound as an emulsion-dispersing agent based on the latex solid content.

(Emulsion-dispersing Agent)

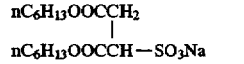

(3) Coating of Undercoat Layer

On the above-described first undercoat layer provided on both surfaces of the film, the second undercoat layer having the following composition was coated on each surface by a wire bar coder method to give the coating amount shown below and then dried at 155° C.

| | |
|---|---|
| Gelatin | 80 mg/m² |
| Dye Dispersion B (as dye solid content) | 8 mg/m² |
| Coating Aid-VI | 1.8 mg/m² |
| Compound-VIII | 0.27 mg/m² |
| Matting Agent: polymethyl methacrylate having an average particle size of 2.5 μm | 2.5 mg/m² |

Coating Aid-VI

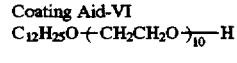

Compound-VIII

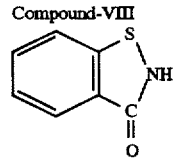

0.27 mg/m²

(Preparation of Photographic Material)

On both surfaces of the thus prepared support, the auxiliary developing agent layer, the emulsion layer and the surface protective layer prepared above were coated in combination by a co-extrusion method. The coated silver amount was 0.80 g/m² per one surface. In this way, samples shown in Tables 2 and 3 were prepared.

TABLE 2

| Coated Sample | Emulsified Product | Total Coated Amount of Coupler for Color Formation (per one surface) (mol/m²) | Coated Amount of Reducing Agent for Color Formation (per one surface) (mol/m²) | Emulsion |
|---|---|---|---|---|
| 1 (Comparison) | — | — | — | A |
| 2 (Invention) | A' | $3.53 \times 10^{-4}$ | $3.7 \times 10^{-3}$ | " |
| 3 (") | B' | " | " | " |
| 4 (") | C' | " | " | " |
| 5 (") | D' | " | " | " |

TABLE 2-continued

| Coated Sample | Emulsified Product | Total Coated Amount of Coupler for Color Formation (per one surface) (mol/m$^2$) | Coated Amount of Reducing Agent for Color Formation (per one surface) (mol/m$^2$) | Emulsion |
|---|---|---|---|---|
| 6 (Comparison) | — | — | — | B |
| 7 (Invention) | A' | $3.53 \times 10^{-4}$ | $3.7 \times 10^{-3}$ | " |
| 8 (") | B' | " | " | " |
| 9 (") | C' | " | " | " |
| 10 (") | D' | " | " | " |
| 11 (Comparison) | — | — | — | C |
| 12 (") | A' | $3.53 \times 10^{-4}$ | $3.7 \times 10^{-3}$ | " |
| 13 (") | B' | " | " | " |
| 14 (") | C' | " | " | " |
| 15 (") | D' | " | " | " |

TABLE 3

| Coated Sample | Emulsified Product | Total Coated Amount of Coupler for Color Formation (per one surface) (mol/m$^2$) | Coated Amount of Reducing Agent for Color Formation (per one surface) (mol/m$^2$) | Emulsion |
|---|---|---|---|---|
| 16 (Comparison) | — | — | — | D |
| 17 (Invention) | A' | $3.54 \times 10^{-4}$ | $3.7 \times 10^{-3}$ | " |
| 18 (") | B' | " | " | " |
| 19 (") | C' | " | " | " |
| 20 (") | D' | " | " | " |
| 21 (Comparison) | — | — | — | E |
| 22 (Invention) | A' | $3.54 \times 10^{-4}$ | $3.7 \times 10^{-3}$ | " |
| 23 (") | B' | " | " | " |
| 24 (") | C' | " | " | " |
| 25 (") | D' | " | " | " |
| 26 (Comparison) | — | — | — | F |
| 27 (") | A' | $3.54 \times 10^{-4}$ | $3.7 \times 10^{-3}$ | " |
| 28 (") | B' | " | " | " |
| 29 (") | C' | " | " | " |
| 30 (") | D' | " | " | " |

(Evaluation of Photographic Performance)

An HR-4 screen manufactured by Fuji Photo Film Co., Ltd. was firmly bonded onto both surfaces of the light-sensitive material prepared above and exposed to light from both surfaces for 0.05 second to effect X-ray sensitometry.

The exposure amount was controlled by varying the distance between the X-ray tube and the cassette. After the exposure, the light-sensitive material was subjected to the processing in an automatic developing machine using the following developer and fixing solution.

(Processing)

Automatic Developing Machine

CEPROS-30 manufactured by Fuji Photo Film Co., Ltd., modified so that a rinsing tank is provided between the fixing tank and the water washing tank.

Developer-1

| | Tank Solution | Replenisher |
|---|---|---|
| Water | 800 ml | 800 ml |
| Tripotassium phosphate | 30 g | 39 g |
| 5-Nitrobenzotriazole | 0.1 g | 0.25 g |
| Disodium N,N-bis(sulfonato-ethyl)hydroxylamine | 3.3 g | 6.6 g |
| Potassium chloride | 10 g | — |

-continued

| | Tank Solution | Replenisher |
|---|---|---|
| Hydroxyethylidene-1,1-disphosphonic acid (30% soln.) | 4 ml | 4 ml |
| 1-Phenyl-4-methyl-4-hydroxy-methyl-3-pyrazolidone | 1.5 g | — |
| Water to make: 1 l | pH 12.0 | |

Developer-2 (alkali activating solution)

A solution resulting from eliminating an auxiliary developing agent (1-phenyl-4-methyl-4-hydroxymethyl-3-pyrazolidone) from Developer-1 was used as Developer-2.

| Fixing Solution: | |
|---|---|
| Ammonium thiosulfate (70 wt/vol %) | 3,000 ml |
| Disodium ethylenediamine tetraacetate dihydrate | 0.45 g |
| Sodium sulfite | 225 g |
| Boric acid | 60 g |
| 1-(N,N-Diethylamine)-ethyl-5-mercaptotetrazole | 15 g |
| Tartaric acid | 48 g |
| Glacial acetic acid | 675 g |
| Sodium hydroxide | 225 g |
| Sulfuric acid (36N) | 58.5 g |

-continued

| | |
|---|---|
| Aluminum sulfate | 150 g |
| Water to make | 6,000 ml |
| pH | 4.68 |
| (Rinsing Solution) | |
| $K_3CO_3$ | 30 g |
| Tetrabutylammonium bromide | 8 g |
| Acetic acid | 6.8 g |
| Water to make | 1 l |
| pH | 10.00 |

The water washing tank was filled with tap water.

As a deposit inhibitor, three polyethylene-made bottles (the orifice of each bottle was covered by a 300-mesh nylon cloth, and water and microbes can pass through this cloth) each packed with 0.4 g of perlite having an average particle size of 100 μm and an average pore size of 3 μm and having carried thereon Actinomyces were prepared. Of these bottles, two were placed on the bottom of the water washing tank and one was placed on the bottom of the stock tank (amount of solution: 0.2 l) for the washing water.

| Processing Speed and Processing Tank: | | |
|---|---|---|
| Development | 40° C. | 10 seconds |
| Fixing | 30° C. | 7.7 seconds |
| Rinsing | 17° C. | 5.0 seconds |
| Water Washing | 17° C. | 5.0 seconds |
| Squeezing | | 3.3 seconds |
| Drying | 58° C. | 9.0 seconds |
| Total | | 40 seconds |
| Replenishing Amount: | | |
| Developer | 12 ml/10 × 12 inch | |
| Fixing solution | 12 ml/10 × 12 inch | |

As seen in Tables 4 and 5, the light-sensitive materials of the present invention exhibited good results in evalution of the sensitometry.

TABLE 4

| Coated Sample | Sensitivity | Fog | Developer |
|---|---|---|---|
| 1 | 80 | 0.12 | Developer-1 |
| 2 | 140 | 0.13 | " |
| 3 | 150 | 0.14 | " |
| 4 | 140 | 0.13 | " |
| 5 | 140 | 0.13 | " |
| 6 | 60 | 0.10 | " |
| 7 | 130 | 0.11 | " |
| 8 | 130 | 0.13 | " |
| 9 | 120 | 0.13 | " |
| 10 | 125 | 0.14 | " |
| 11 | 100 | 0.12 | " |
| 12 | 95 | 0.15 | " |
| 13 | 80 | 0.17 | " |
| 14 | 105 | 0.16 | " |
| 15 | 100 | 0.19 | " |
| 16 | 60 | 0.10 | " |
| 17 | 90 | 0.15 | " |
| 18 | 80 | 0.14 | " |
| 19 | 100 | 0.14 | " |
| 20 | 90 | 0.14 | " |
| 21 | 70 | 0.11 | " |
| 22 | 115 | 0.12 | " |
| 23 | 120 | 0.13 | " |
| 24 | 120 | 0.12 | " |
| 25 | 115 | 0.11 | " |
| 26 | 70 | 0.10 | " |
| 27 | 60 | 0.14 | " |
| 28 | 70 | 0.15 | " |
| 29 | 80 | 0.16 | " |
| 30 | 60 | 0.16 | " |

TABLE 5

| Coated Sample | Sensitivity | Fog | Developer |
|---|---|---|---|
| 1 | 0 | 0 | Developer-2 |
| 2 | 130 | 0.10 | " |
| 3 | 140 | 0.11 | " |
| 4 | 135 | 0.10 | " |
| 5 | 135 | 0.11 | " |
| 6 | 0 | 0 | " |
| 7 | 125 | 0.11 | " |
| 8 | 120 | 0.12 | " |
| 9 | 110 | 0.11 | " |
| 10 | 120 | 0.12 | " |
| 11 | 0 | 0 | " |
| 12 | 60 | 0.13 | " |
| 13 | 40 | 0.14 | " |
| 14 | 40 | 0.14 | " |
| 15 | 50 | 0.15 | " |
| 16 | 0 | 0 | " |
| 17 | 30 | 0.14 | " |
| 18 | 20 | 0.13 | " |
| 19 | 40 | 0.13 | " |
| 20 | 40 | 0.13 | " |
| 21 | 0 | 0 | " |
| 22 | 110 | 0.10 | " |
| 23 | 120 | 0.11 | " |
| 24 | 120 | 0.11 | " |
| 25 | 120 | 0.12 | " |
| 26 | 0 | 0 | " |
| 27 | 20 | 0.12 | " |
| 28 | 30 | 0.12 | " |
| 29 | 50 | 0.13 | " |
| 30 | 40 | 0.14 | " |

EXAMPLE 2

Emulsified products were prepared thoroughly in the same manner as in Example 1 except for using Solvent Solv-2 in place of Solvent Solv-1 in dissolving the coupler for color formation and the reducing agent for color formation, and the coated samples were prepared thoroughly in the same manner. The evaluation of the photographic performance and the processing were conducted thoroughly in the same manner as in Example 1 except for eliminating the rinsing step. As a result, the samples of the present invention exhibited good photographic performance.

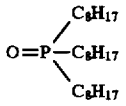

Solv-2

EXAMPLE 3

The coated samples were prepared thoroughly in the same manner as in Example 1 except for changing the coating amount of Dye Dispersion B in the second undercoat layer to 30 mg/m$^2$ in step (3) of coating an undercoat layer in the "preparation of support" in Example 1. The thus-prepared samples of the present invention each was evaluated in terms of crossover light according to the method described in JP-A-1-17282 (corresponding to U.S. Pat. No. 4,803,150) and processed thoroughly in the same manner as in Example 1. As a result, in each sample, the crossover light was 20% or less. These samples were measured on the sharpness according to the following method.

Measurement of Sharpness (MTF)

Using the HR-4 screen and the automatic developing machine described above in combination, the MTF was measured at an aperture of 30 μm×500 μm. The evaluation was conducted using the MTF value at a spacial frequency of 1.0 cycle/mm on the part where the optical density was 1.0.

As a result, it was found that the photographic light-sensitive materials of the present invention exhibited excellent photographic performance.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising:

(a) a silver chloride-containing emulsion comprising a dispersion medium and a silver halide grain, wherein the silver halide grain contains a tabular grain having an aspect ratio of not less than 2 accounting for at least 50% of the entire projected area thereof and has a silver chloride content of not less than 20 mol %;

(b) a developing agent; and (c) a compound capable of forming a dye image upon development.

2. The silver halide photographic material as claimed in claim 1, wherein the material forms an image comprising a developed silver image and a dye image.

3. The silver halide photographic material as claimed in claim 1, wherein the material can be processed by an automatic developing machine within a total processing time of not more than 90 seconds.

4. The silver halide photographic material as claimed in claim 1, wherein the material comprises a support having emulsion layers on both sides of the support and is set to have a crossover light of less than 20% in an X-ray image formation system of forming an image in combination with a phosphor screen.

5. The silver halide photographic material as claimed in claim 1, wherein the developing agent (b) is a color developing agent and the compound (c) is a coupler which forms a dye by coupling reaction with an oxidation product of the developing agent produced by the development.

6. The silver halide photographic material as claimed in claim 5, wherein the color developing agent is at least one developing agent represented by formulae (I) to (III):

$$R(1)-NHNH-X(1)-R(2) \quad (I)$$

(II)

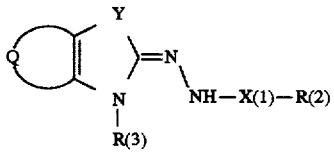

(III)

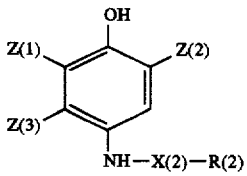

wherein R(1) represents an aryl group; X(1) represents a carbonyl group, a sulfonyl group or a phosphoryl group; R(2) represents an alkyl group, an aryl group, an arylamino group, an alkylamino group, an aryloxy group or an alkoxy group; Q represents a nonmetallic atom group necessary for forming a ring by condensation with the heterocyclic ring in formula (II); Y represents an oxygen atom, a sulfur atom or =N—R(3); R(3) represents an alkyl group or an aryl group; Z(1) to Z(3) each represents an alkyl group, an alkenyl group, an alkynyl group, an aryl group, an acyloxy group, a carbaioyloxy group, a carbonamido group, a sulfonamido group, a carbamoyl group, a sulfamoyl group, an alkoxy group, an aryloxy group, an alkoxycarbonyl group, an N-acylsulfamoyl group, an alkylsulfonyl group, an arylsulfonyl group, an alkoxycarbonylamino group, an aryloxycarbonylamino group, an amino group, a cyano group, a nitro group, a carboxyl group, a hydroxy group, a sulfo group, a mercapto group, an alkylsulfinyl group, an arylsulfonyl group, an alkylthio group, an arylthio group, a ureido group, a heterocyclic group, an acyl group, a sulfamoylamino group, a silyl group or a halogen atom; and X(2) represents a sulfonyl group.

7. The silver halide photographic material as claimed in claim 5, wherein the coupler is represented by formula (1) or (2):

$$R^{14}-\underset{\underset{Y}{|}}{CH}-CONH-R^{15} \quad (1)$$

$$R^{14}-\underset{\underset{Y}{|}}{CH}-COO-R^{15} \quad (2)$$

wherein $R^{14}$ represents an acyl group, a cyano group, a nitro group, an aryl group, a heterocyclic group, an alkoxycarbonyl group, an aryloxycarbonyl group, a carbamoyl group, a sulfamoyl group, an alkyl sulfonyl group or an arylsulfonyl group, which groups each may have a substituent; $R^{15}$ represents an alkyl group, an aryl group or a heterocyclic group, which groups each may have a substituent; and Y represents a hydrogen atom or a group capable of splitting off upon coupling reaction with the oxidation product of the developing agent.

8. The silver halide photographic material as claimed in claim 5, wherein the amount of the color developing agent present is from 0.01 to 100 times the amount of the coupler.

9. The silver halide photographic material as claimed in claim 5, wherein the coupler is present in an amount of from 0.001 to 100 mmol/$m^2$.

10. The silver halide photographic material as claimed in claim 1, further comprising an auxiliary developing agent.

11. The silver halide photographic material as claimed in claim 10, wherein the auxiliary developing agent is represented by formula (B-1) or (B-2):

(B-1)

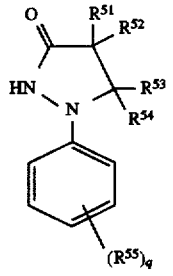

-continued (B-2)

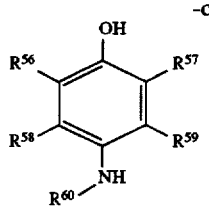

wherein $R^{51}$ to $R^{54}$ each represents a hydrogen atom, an alkyl group, a cycloalkyl group, an alkenyl group, an aryl group or a heterocyclic group;

$R^{55}$ to $R^{59}$ each represents a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocyclic oxy group, a silyloxy group, an acyloxy group, an amino group, an anilino group, a heterocyclic amino group, an alkylthio group, an arylthio group, a heterocyclic thio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an allenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamido group, a sulfamoylamino group, an alkylsulfinyl group, an allensulfinyl group, an alkanesulfonyl group, an allenesulfonyl group, a sulfamoyl group, a sulfo group, a phosphinoyl group or a phosphinoylamino group;

q represents an integer of from 0 to 5 and when q is 2 or greater, the $R^{55}$ groups may be the same or different; and $R^{60}$ represents an alkyl group or an aryl group.

12. The silver halide photographic material as claimed in claim 1, wherein the material comprises a support having a silver halide emulsion layer and the silver amount in the silver halide emulsion layer is from 0.5 to 5 $g/m^2$.

13. The silver halide photographic material as claimed in claim 2, wherein the dye image is substantially black.

14. The silver halide photographic material as claimed in claim 1, wherein said material is a black and white X-ray photograpic material for medical use.

* * * * *

UNITED STATES PATENT AND TRADEMARK OFFICE

CERTIFICATE OF CORRECTION

PATENT NO. : 5,776,664

DATED : July 7, 1998

INVENTOR(S) : Seiji Yamashita et al.

It is certified that error appears in the above-identified patent and that said Letters Patent is hereby corrected as shown below:

In column 35, line 41, delete "allensulfinyl" and insert --allenesulfinyl--.

In claim 11, line 27, delete "allensulfinyl" and insert --allenesulfinyl--.

In claim 14, line 3, delete "photograpic" and insert --photographic--.

Signed and Sealed this

Ninth Day of March, 1999

*Attest:*

*Attesting Officer*

Q. TODD DICKINSON

*Acting Commissioner of Patents and Trademarks*